US012479067B2

(12) United States Patent
Eckel et al.

(10) Patent No.: US 12,479,067 B2
(45) Date of Patent: Nov. 25, 2025

(54) PATTERNED ABRASIVE SUBSTRATE AND METHOD

(71) Applicant: 3M INNOVATIVE PROPERTIES COMPANY, St. Paul, MN (US)

(72) Inventors: Joseph B. Eckel, Vadnais Heights, MN (US); Aaron K. Nienaber, Lake Elmo, MN (US); Thomas J. Nelson, Woodbury, MN (US); Ann M. Hawkins, Lake Elmo, MN (US); Amelia W. Koenig, Minneapolis, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 618 days.

(21) Appl. No.: 17/415,071

(22) PCT Filed: Dec. 17, 2019

(86) PCT No.: PCT/IB2019/060947
§ 371 (c)(1),
(2) Date: Jun. 17, 2021

(87) PCT Pub. No.: WO2020/128852
PCT Pub. Date: Jun. 25, 2020

(65) Prior Publication Data

US 2022/0040814 A1 Feb. 10, 2022

Related U.S. Application Data

(60) Provisional application No. 62/781,021, filed on Dec. 18, 2018.

(51) Int. Cl.
*B24D 3/28* (2006.01)

(52) U.S. Cl.
CPC ..... *B24D 3/28* (2013.01); *B24D 2203/00* (2013.01)

(58) Field of Classification Search
CPC ..... B24D 3/28; B24D 2203/00
USPC ..... 451/539
See application file for complete search history.

(56) References Cited

U.S. PATENT DOCUMENTS

| | | | |
|---|---|---|---|
| 1,910,444 | A | 5/1933 | Nicholson |
| 2,141,658 | A | 12/1938 | Melton |
| 3,041,156 | A | 6/1962 | Rowse |
| 3,058,819 | A | 10/1962 | Paulson |
| 3,616,580 | A | 11/1971 | Dewell |

(Continued)

FOREIGN PATENT DOCUMENTS

| | | |
|---|---|---|
| EP | 1207015 | 5/2002 |
| EP | 3086903 | 7/2015 |

(Continued)

OTHER PUBLICATIONS

Machine Translation of KR-2015-0067357-A (Year: 2015).*

(Continued)

*Primary Examiner* — C. A. Rivera

(57) ABSTRACT

Abrasive articles and associated methods are shown that include abrasive particles arranged in one or more symbols on a backing substrate. Examples include shaped abrasive particles arranged into one or more symbols. Other examples include one or more wear particles with a height less than other abrasive particles, such that when exposed, the wear particles indicate a wear condition of the abrasive article.

13 Claims, 16 Drawing Sheets

(56) References Cited

U.S. PATENT DOCUMENTS

| | | | | |
|---|---|---|---|---|
| 3,676,092 | A | 7/1972 | Buell | |
| 3,729,873 | A | 5/1973 | Sandell | |
| 3,784,365 | A | 1/1974 | Caserta | |
| 3,833,346 | A | 9/1974 | Wirth | |
| 3,868,232 | A | 2/1975 | Sioui | |
| 3,869,834 | A | 3/1975 | Mullin | |
| 4,215,516 | A | 8/1980 | Huschle | |
| 4,314,827 | A | 2/1982 | Leitheiser | |
| 4,475,926 | A | 10/1984 | Hickory | |
| 4,623,364 | A | 11/1986 | Cottringer | |
| 4,652,275 | A | 3/1987 | Bloecher | |
| 4,734,104 | A | 3/1988 | Broberg | |
| 4,737,163 | A | 4/1988 | Larkey | |
| 4,744,802 | A | 5/1988 | Schwabel | |
| 4,751,138 | A | 6/1988 | Tumey | |
| 4,770,671 | A | 9/1988 | Monroe | |
| 4,799,939 | A | 1/1989 | Bloecher | |
| 4,881,951 | A | 11/1989 | Wood | |
| 4,997,461 | A | 3/1991 | Markhoff-Matheny | |
| 5,009,675 | A | 4/1991 | Kunz | |
| 5,011,508 | A | 4/1991 | Wald | |
| 5,042,991 | A | 8/1991 | Kunz | |
| 5,078,753 | A | 1/1992 | Broberg | |
| 5,085,671 | A | 2/1992 | Martin | |
| 5,152,917 | A | 10/1992 | Pieper | |
| 5,201,916 | A | 4/1993 | Berg | |
| 5,203,884 | A | 4/1993 | Buchanan | |
| 5,213,591 | A | 5/1993 | Celikkaya | |
| 5,269,821 | A | 12/1993 | Helmin | |
| 5,352,254 | A | 10/1994 | Celikkaya | |
| 5,366,523 | A | 11/1994 | Rowenhorst | |
| 5,378,251 | A | 1/1995 | Culler | |
| 5,417,726 | A | 5/1995 | Stout | |
| 5,435,816 | A | 7/1995 | Spurgeon | |
| 5,436,063 | A | 7/1995 | Follett | |
| 5,453,106 | A | 9/1995 | Roberts | |
| 5,496,386 | A | 3/1996 | Broberg | |
| 5,498,268 | A | 3/1996 | Gagliardi | |
| 5,520,711 | A | 5/1996 | Helmin | |
| 5,609,706 | A | 3/1997 | Benedict | |
| RE35,570 | E | 7/1997 | Rowenhorst | |
| 5,672,097 | A | 9/1997 | Hoopman | |
| 5,766,277 | A | 6/1998 | DeVoe | |
| 5,946,991 | A | 9/1999 | Hoopman | |
| 5,954,844 | A | 9/1999 | Law | |
| 5,961,674 | A | 10/1999 | Gagliardi | |
| 5,975,987 | A | 11/1999 | Hoopman | |
| 5,975,988 | A | 11/1999 | Christianson | |
| 5,984,988 | A | 11/1999 | Berg | |
| 6,077,601 | A | 6/2000 | DeVoe | |
| 6,129,540 | A | 10/2000 | Hoopman | |
| 6,228,133 | B1 | 5/2001 | Thurber | |
| 6,599,177 | B2 * | 7/2003 | Nevoret | B24D 11/008 451/526 |
| 7,553,346 | B2 | 6/2009 | Welygan | |
| 8,034,137 | B2 | 10/2011 | Erickson | |
| 8,080,072 | B2 | 12/2011 | Woo | |
| 8,142,531 | B2 | 3/2012 | Adefris | |
| 8,142,532 | B2 | 3/2012 | Erickson | |
| 8,142,891 | B2 | 3/2012 | Culler | |
| 9,017,150 | B2 | 4/2015 | Keipert | |
| 9,440,332 | B2 | 9/2016 | Gaeta | |
| 9,457,453 | B2 | 10/2016 | Seth | |
| 9,604,346 | B2 | 3/2017 | Breder | |
| 9,776,302 | B2 | 10/2017 | Keipert | |
| 9,969,057 | B2 | 5/2018 | Eugster | |
| 2001/0003884 | A1 | 6/2001 | Wei | |
| 2004/0082288 | A1 * | 4/2004 | Tietz | B24D 3/28 451/526 |
| 2009/0165394 | A1 | 7/2009 | Culler | |
| 2009/0169816 | A1 | 7/2009 | Erickson | |
| 2011/0021114 | A1 * | 1/2011 | McArdle | B24B 37/245 451/8 |
| 2012/0227333 | A1 | 9/2012 | Adefris | |
| 2013/0040537 | A1 | 2/2013 | Schwabel | |
| 2013/0125477 | A1 | 5/2013 | Adefris | |
| 2013/0344786 | A1 | 12/2013 | Keipert | |
| 2014/0106126 | A1 | 4/2014 | Gaeta | |
| 2014/0290147 | A1 | 10/2014 | Seth | |
| 2015/0224629 | A1 | 8/2015 | Moren | |
| 2015/0291866 | A1 | 10/2015 | Arcona | |
| 2016/0311081 | A1 | 10/2016 | Culler | |
| 2016/0311084 | A1 | 10/2016 | Culler | |
| 2016/0315081 | A1 | 10/2016 | Park | |
| 2017/0050293 | A1 | 2/2017 | Gaeta | |
| 2017/0225299 | A1 | 8/2017 | Keipert | |
| 2017/0368667 | A1 | 12/2017 | Keipert | |
| 2018/0029194 | A1 | 2/2018 | Keipert | |
| 2018/0086957 | A1 | 3/2018 | Sahlin | |

FOREIGN PATENT DOCUMENTS

| | | | | |
|---|---|---|---|---|
| EP | 3319758 | | 1/2017 | |
| KR | 20150067357 | A * | 6/2015 | B24D 11/04 |
| WO | WO 2003-008151 | | 1/2003 | |
| WO | WO 2007-005452 | | 1/2007 | |
| WO | WO 2011-068714 | | 6/2011 | |
| WO | WO-2011139562 | A2 * | 11/2011 | B24D 11/00 |
| WO | WO 2012-112305 | | 8/2012 | |
| WO | WO 2012-112322 | | 8/2012 | |
| WO | WO 2014-131937 | | 9/2014 | |
| WO | WO 2014-176108 | | 10/2014 | |
| WO | WO 2014-206967 | | 12/2014 | |
| WO | WO 2015-100018 | | 7/2015 | |
| WO | WO 2015-100020 | | 7/2015 | |
| WO | WO 2015-100220 | | 7/2015 | |
| WO | WO 2016-028683 | | 2/2016 | |
| WO | WO 2016-044158 | | 3/2016 | |
| WO | WO 2016-064726 | | 4/2016 | |
| WO | WO 2016-089675 | | 6/2016 | |
| WO | WO-2016089675 | A1 * | 6/2016 | B24D 11/00 |
| WO | WO 2016-205133 | | 12/2016 | |
| WO | WO 2016-205267 | | 12/2016 | |
| WO | WO 2017-007703 | | 1/2017 | |
| WO | WO 2017-007714 | | 1/2017 | |
| WO | WO 2017-083249 | | 5/2017 | |
| WO | WO 2017-083255 | | 5/2017 | |
| WO | WO 2018-080765 | | 5/2018 | |
| WO | WO 2018-118596 | | 6/2018 | |
| WO | WO 2018-118690 | | 6/2018 | |
| WO | WO 2018-118695 | | 6/2018 | |
| WO | WO 2018-134732 | | 7/2018 | |
| WO | WO 2018-207145 | | 11/2018 | |
| WO | WO 2019-215571 | | 11/2019 | |
| WO | WO 2020-128716 | | 6/2020 | |
| WO | WO 2020-128717 | | 6/2020 | |
| WO | WO 2020-128719 | | 6/2020 | |
| WO | WO 2020-128720 | | 6/2020 | |
| WO | WO 2020-128752 | | 6/2020 | |
| WO | WO 2020-128833 | | 6/2020 | |
| WO | WO 2020-128838 | | 6/2020 | |
| WO | WO 2020-128842 | | 6/2020 | |
| WO | WO 2020-128844 | | 6/2020 | |
| WO | WO 2020-128845 | | 6/2020 | |
| WO | WO 2020-128853 | | 6/2020 | |
| WO | WO 2020-128854 | | 6/2020 | |
| WO | WO 2020-128857 | | 6/2020 | |
| WO | WO 2020-128858 | | 6/2020 | |

OTHER PUBLICATIONS

International Search Report for PCT International Application No. PCT/IB2019/060613, mailed on Feb. 21, 2020, 4 pages.
International Search Report for PCT International Application No. PCT/IB2019/060615, mailed on Feb. 26, 2020, 5 pages.
International Search Report for PCT International Application No. PCT/IB2019/060624, mailed on Mar. 11, 2020, 4 pages.
International Search Report for PCT International Application No. PCT/IB2019/060627, mailed on Jul. 2, 2020, 8 pages.
International Search Report for PCT International Application No. PCT/IB2019/060779, mailed on Mar. 10, 2020, 5 pages.
International Search Report for PCT International Application No. PCT/IB2019/060924, mailed on Apr. 29, 2020, 4 pages.

(56) References Cited

OTHER PUBLICATIONS

International Search Report for PCT International Application No. PCT/IB2019/060929, mailed on Mar. 23, 2020, 4 pages.
International Search Report for PCT International Application No. PCT/IB2019/060934, mailed on Mar. 18, 2020, 5 pages.
International Search Report for PCT International Application No. PCT/IB2019/060936, mailed on Mar. 30, 2020, 5 pages.
International Search Report for PCT International Application No. PCT/IB2019/060938, mailed on Apr. 28, 2020, 4 pages.
International Search Report for PCT International Application No. PCT/IB2019/060947, mailed on Mar. 30, 2020, 5 pages.
International Search Report for PCT International Application No. PCT/IB2019/060949, mailed on Jun. 5, 2020, 4 pages.
International Search Report for PCT International Application No. PCT/IB2019/060950, mailed on Mar. 30, 2020, 5 pages.
International Search Report for PCT International Application No. PCT/IB2019/060953, mailed on Apr. 2, 2020, 4 pages.
International Search Report for PCT International Application No. PCT/IB2019/060954, mailed on Apr. 24, 2020, 5 pages.

* cited by examiner

PATTERNED ABRASIVE SUBSTRATE AND METHOD

CROSS REFERENCE TO RELATED APPLICATIONS

This application is a national stage filing under 35 U.S.C. 371 of PCT/IB2019/060947, filed Dec. 17, 2019, which claims the benefit of U.S. Provisional Application No. 62/781,021, filed Dec. 18, 2018, the disclosures of which are incorporated by reference in their entireties herein.

BACKGROUND

Abrasive articles are used in any number of day to day applications and in industrial manufacturing operations. Removal of material is often used to transform a rough cut or rough form into a more finished and burr-free form. Abrasive articles have a useful lifetime due in part to wear of the abrasive particles used. It is desirable to provide information to a user about the abrasive article being used. It is further desired to have higher performing abrasive articles with improved manufacturing processes to produce the abrasive articles.

BRIEF DESCRIPTION OF THE FIGURES

The drawings illustrate generally, by way of example, but not by way of limitation, various embodiments discussed in the present document.

DETAILED DESCRIPTION

Figure 1A:
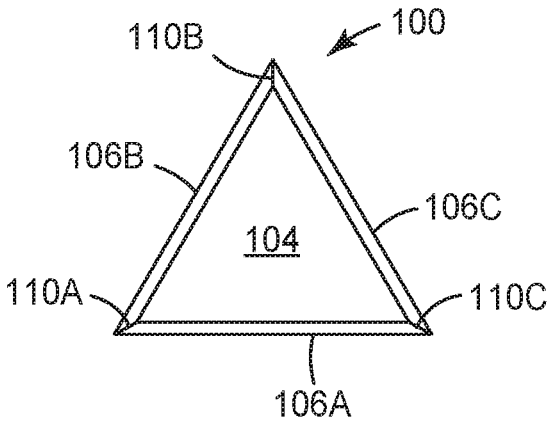
FIGS. 1A-1B are schematic diagrams of shaped abrasive particles having a planar trigonal shape, in accordance with various embodiments.

Reference will now be made in detail to certain embodiments of the disclosed subject matter, examples of which are illustrated in part in the accompanying drawings. While the disclosed subject matter will be described in conjunction with the enumerated claims, it will be understood that the exemplified subject matter is not intended to limit the claims to the disclosed subject matter.

Throughout this document, values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "about 0.1% to about 5%" or "about 0.1% to 5%" should be interpreted to include not just about 0.1% to about 5%, but also the individual values (e.g., 1%, 2%, 3%, and 4%) and the sub-ranges (e.g., 0.1% to 0.5%, 1.1% to 2.2%, 3.3% to 4.4%) within the indicated range. The statement "about X to Y" has the same meaning as "about X to about Y," unless indicated otherwise. Likewise, the statement "about X, Y, or about Z" has the same meaning as "about X, about Y, or about Z," unless indicated otherwise.

In this document, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed herein, and not otherwise defined, is for the purpose of description only and not of limitation. Any use of section headings is intended to aid reading of the document and is not to be interpreted as limiting; information that is relevant to a section heading may occur within or outside of that particular section.

In the methods described herein, the acts can be carried out in any order without departing from the principles of the disclosure, except when a temporal or operational sequence is explicitly recited. Furthermore, specified acts can be carried out concurrently unless explicit claim language recites that they be carried out separately. For example, a claimed act of doing X and a claimed act of doing Y can be conducted simultaneously within a single operation, and the resulting process will fall within the literal scope of the claimed process.

The term "about" as used herein can allow for a degree of variability in a value or range, for example, within 10%, within 5%, or within 1% of a stated value or of a stated limit of a range, and includes the exact stated value or range.

The term "substantially" as used herein refers to a majority of, or mostly, as in at least about 50%, 60%, 70%, 80%, 90%, 95%, 96%, 97%, 98%, 99%, 99.5%, 99.9%, 99.99%, or at least about 99.999% or more, or 100%.

As used herein "shaped abrasive particle" means an abrasive particle having a predetermined or non-random shape. One process to make a shaped abrasive particle such as a shaped ceramic abrasive particle includes shaping the precursor ceramic abrasive particle in a mold having a predetermined shape to make ceramic shaped abrasive particles. Ceramic shaped abrasive particles, formed in a mold, are one species in the genus of shaped ceramic abrasive particles. Other processes to make other species of shaped ceramic abrasive particles include extruding the precursor ceramic abrasive particle through an orifice having a predetermined shape, printing the precursor ceramic abrasive particle though an opening in a printing screen having a predetermined shape, or embossing the precursor ceramic abrasive particle into a predetermined shape or pattern. In other examples, the shaped ceramic abrasive particles can be cut from a sheet into individual particles. Examples of suitable cutting methods include mechanical cutting, laser cutting, or water jet cutting. Non-limiting examples of shaped ceramic abrasive particles include shaped abrasive particles, such as triangular plates, or elongated ceramic rods/filaments. Shaped ceramic abrasive particles are generally homogenous or substantially uniform and maintain their sintered shape without the use of a binder such as an organic or inorganic binder that bonds smaller abrasive particles into an agglomerated structure and excludes abrasive particles obtained by a crushing or comminution process that produces abrasive particles of random size and shape. In many embodiments, the shaped ceramic abrasive particles comprise a homogeneous structure of sintered alpha alumina or consist essentially of sintered alpha alumina.

Figure 1B:
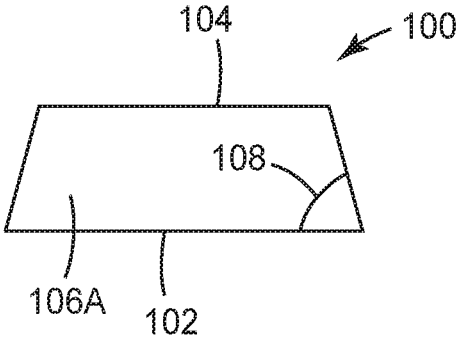

FIGS. 1A and 1B show an example of shaped abrasive particle 100, as an equilateral triangle conforming to a truncated pyramid. As shown in FIGS. 1A and 1B shaped abrasive particle 100 includes a truncated regular triangular pyramid bounded by a triangular base 102, a triangular top 104, and plurality of sloping sides 106A, 106B, 106C connecting triangular base 102 (shown as equilateral although scalene, obtuse, isosceles, and right triangles are possible) and triangular top 104. Slope angle 108A is the dihedral angle formed by the intersection of side 106A with triangular base 102. Similarly, slope angles 108B and 108C (both not shown) correspond to the dihedral angles formed by the respective intersections of sides 106B and 106C with triangular base 102. In the case of shaped abrasive particle 100, all of the slope angles have equal value. In some embodiments, side edges 110A, 110B, and 110C have an average radius of curvature in a range of from about 0.5 μm to about 80 μm, about 10 μm to about 60 μm, or less than, equal to, or greater than about 0.5 μm, 5, 10, 15, 20, 25, 30, 35, 40, 45, 50, 55, 60, 65, 70, 75, or about 80 μm.

In the embodiment shown in FIGS. 1A and 1B, sides 106A, 106B, and 106C have equal dimensions and form dihedral angles with the triangular base 102 of about 82 degrees (corresponding to a slope angle of 82 degrees). However, it will be recognized that other dihedral angles (including 90 degrees) may also be used. For example, the dihedral angle between the base and each of the sides may independently range from 45 to 90 degrees (for example, from 70 to 90 degrees, or from 75 to 85 degrees). Edges connecting sides 106, base 102, and top 104 can have any suitable length. For example, a length of the edges may be in a range of from about 0.5 μm to about 2000 μm, about 150 μm to about 200 μm, or less than, equal to, or greater than about 0.5 μm, 50, 100, 150, 200, 250, 300, 350, 400, 450, 500, 550, 600, 650, 700, 750, 800, 850, 900, 950, 1000, 1050, 1100, 1150, 1200, 1250, 1300, 1350, 1400, 1450, 1500, 1550, 1600, 1650, 1700, 1750, 1800, 1850, 1900, 1950, or about 2000 μm.

Figure 2A:
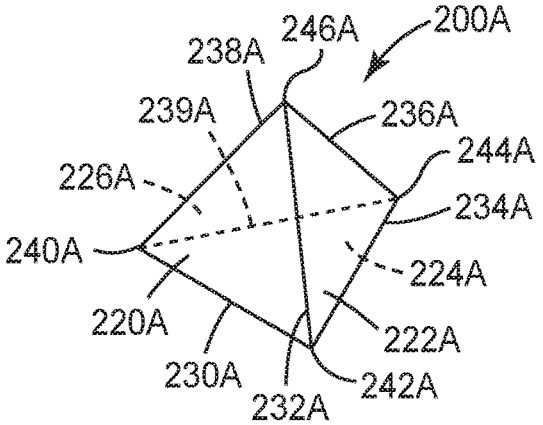
FIGS. 2A-2E are schematic diagrams of shaped abrasive particles having a tetrahedral shape, in accordance with various embodiments.

FIGS. 2A-2E are perspective views of the shaped abrasive particles 200 shaped as tetrahedral abrasive particles. As shown in FIGS. 2A-2E, shaped abrasive particles 200 are shaped as regular tetrahedrons. As shown in FIG. 2A, shaped abrasive particle 200A has four faces (220A, 222A, 224A, and 226A) joined by six edges (230A, 232A, 234A, 236A, 238A, and 239A) terminating at four vertices (240A, 242A, 244A, and 246A). Each of the faces contacts the other three of the faces at the edges. While a regular tetrahedron (e.g., having six equal edges and four faces) is depicted in FIG. 2A, it will be recognized that other shapes are also permissible. For example, tetrahedral abrasive particles 200 can be shaped as irregular tetrahedrons (e.g., having edges of differing lengths).

Figure 2B:
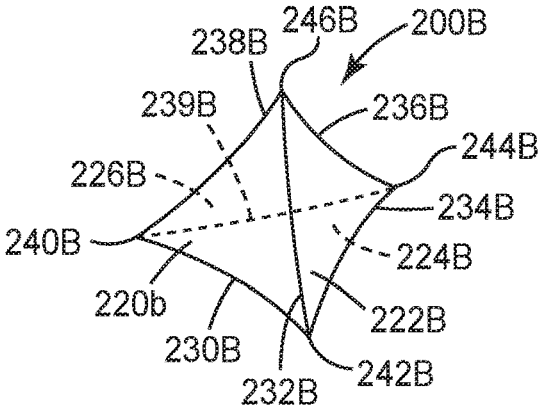

Referring now to FIG. 2B, shaped abrasive particle 200B has four faces (220B, 222B, 224B, and 226B) joined by six edges (230B, 232B, 234B, 236B, 238B, and 239B) terminating at four vertices (240B, 242B, 244B, and 246B). Each of the faces is concave and contacts the other three of the faces at respective common edges. While a particle with tetrahedral symmetry (e.g., four rotational axes of threefold symmetry and six reflective planes of symmetry) is depicted in FIG. 2B, it will be recognized that other shapes are also permissible. For example, shaped abrasive particles 200B can have one, two, or three concave faces with the remainder being planar.

Figure 2C:
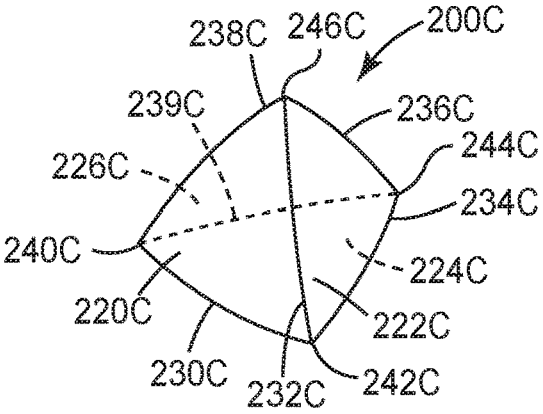

Referring now to FIG. 2C, shaped abrasive particle 200C has four faces (220C, 222C, 224C, and 226C) joined by six edges (230C, 232C, 234C, 236C, 238C, and 239C) terminating at four vertices (240C, 242C, 244C, and 246C). Each of the faces is convex and contacts the other three of the faces at respective common edges. While a particle with tetrahedral symmetry is depicted in FIG. 2C, it will be recognized that other shapes are also permissible. For example, shaped abrasive particles 200C can have one, two, or three convex faces with the remainder being planar or concave.

Figure 2D:
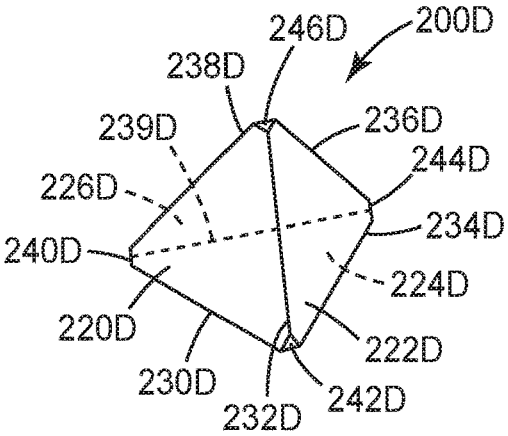

Referring now to FIG. 2D, shaped abrasive particle 200D has four faces (220D, 222D, 224D, and 226D) joined by six edges (230D, 232D, 234D, 236D, 238D, and 239D) terminating at four vertices (240D, 242D, 244D, and 246D). While a particle with tetrahedral symmetry is depicted in FIG. 2D, it will be recognized that other shapes are also permissible. For example, shaped abrasive particles 200D can have one, two, or three convex faces with the remainder being planar.

Figure 2E:
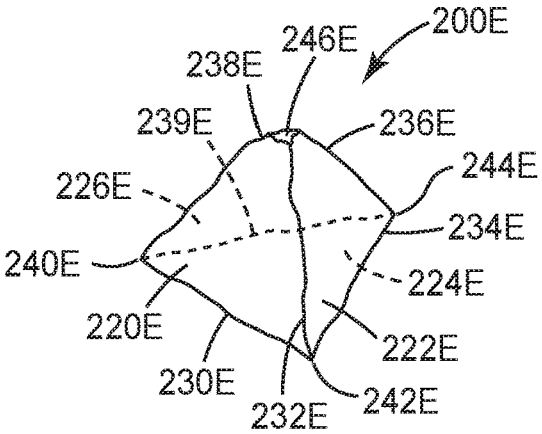

Deviations from the depictions in FIGS. 2A-2D can be present. An example of such a shaped abrasive particle 200 is depicted in FIG. 2E, showing shaped abrasive particle 200E, which has four faces (220E, 222E, 224E, and 226E) joined by six edges (230E, 232E, 234E, 236E, 238E, and 239E) terminating at four vertices (240E, 242E, 244E, and 246E). Each of the faces contacts the other three of the faces at respective common edges. Each of the faces, edges, and vertices has an irregular shape.

In any of shaped abrasive particles 200A-200E, the edges can have the same length or different lengths. The length of any of the edges can be any suitable length. As an example, the length of the edges can be in a range of from about 0.5 μm to about 2000 μm, about 150 μm to about 200 μm, or less than, equal to, or greater than about 0.5 μm, 50, 100, 150, 200, 250, 300, 350, 400, 450, 500, 550, 600, 650, 700, 750, 800, 850, 900, 950, 1000, 1050, 1100, 1150, 1200, 1250, 1300, 1350, 1400, 1450, 1500, 1550, 1600, 1650, 1700, 1750, 1800, 1850, 1900, 1950, or about 2000 μm. shaped abrasive particles 200A-200E can be the same size or different sizes.

Any of shaped abrasive particles 100 or 200 can include any number of shape features. The shape features can help to improve the cutting performance of any of shaped abrasive particles 100 or 200. Examples of suitable shape features include an opening, a concave surface, a convex surface, a groove, a ridge, a fractured surface, a low roundness factor, or a perimeter comprising one or more corner points having a sharp tip. Individual shaped abrasive particles can include any one or more of these features.

In addition to the materials already described, at least one magnetic material may be included within or coated to shaped abrasive particle 100 or 200. Examples of magnetic materials include iron; cobalt; nickel; various alloys of nickel and iron marketed as Permalloy in various grades; various alloys of iron, nickel and cobalt marketed as Fernico, Kovar, FerNiCo I, or FerNiCo II; various alloys of iron, aluminum, nickel, cobalt, and sometimes also copper and/or titanium marketed as Alnico in various grades; alloys of iron, silicon, and aluminum (about 85:9:6 by weight) marketed as Sendust alloy; Heusler alloys (e.g., $Cu_2MnSn$); manganese bismuthide (also known as Bismanol); rare earth magnetizable materials such as gadolinium, dysprosium, holmium, europium oxide, alloys of neodymium, iron and boron (e.g., $Nd_2Fe_{14}B$), and alloys of samarium and cobalt (e.g., $SmCo_5$); MnSb; $MnOFe_2O_3$; $Y_3Fe_5O_{12}$; $CrO_2$; MnAs; ferrites such as ferrite, magnetite; zinc ferrite; nickel ferrite; cobalt ferrite, magnesium ferrite, barium ferrite, and strontium ferrite; yttrium iron garnet; and combinations of the foregoing. In some embodiments, the magnetizable material is an alloy containing 8 to 12 weight percent aluminum, 15 to 26 wt % nickel, 5 to 24 wt % cobalt, up to 6 wt % copper, up to 1% titanium, wherein the balance of material to add up to 100 wt % is iron. In some other embodiments, a magnetizable coating can be deposited on an abrasive particle 100 using a vapor deposition technique such as, for example, physical vapor deposition (PVD) including magnetron sputtering.

Including these magnetizable materials can allow shaped abrasive particle 100 or 200 to be responsive a magnetic field. Any of shaped abrasive particles 100 or 200 can include the same material or include different materials.

Shaped abrasive particle 100 or 200 can be formed in many suitable manners for example, the shaped abrasive particle 100 or 200 can be made according to a multi-operation process. The process can be carried out using any material or precursor dispersion material. Briefly, for embodiments where shaped abrasive particles 100 or 200 are monolithic ceramic particles, the process can include the operations of making either a seeded or non-seeded precursor dispersion that can be converted into a corresponding (e.g., a boehmite sol-gel that can be converted to alpha alumina); filling one or more mold cavities having the desired outer shape of shaped abrasive particle 100 with a precursor dispersion; drying the precursor dispersion to form precursor shaped abrasive particle; removing the precursor shaped abrasive particle 100 from the mold cavities; calcining the precursor shaped abrasive particle 100 to form calcined, precursor shaped abrasive particle 100 or 200; and then sintering the calcined, precursor shaped abrasive particle 100 or 200 to form shaped abrasive particle 100 or 200. The process will now be described in greater detail in the context of alpha-alumina-containing shaped abrasive particle 100 or 200. In other embodiments, the mold cavities may be filled with a melamine to form melamine shaped abrasive particles.

The process can include the operation of providing either a seeded or non-seeded dispersion of a precursor that can be converted into ceramic. In examples where the precursor is seeded, the precursor can be seeded with an oxide of an iron (e.g., FeO). The precursor dispersion can include a liquid that is a volatile component. In one example, the volatile component is water. The dispersion can include a sufficient amount of liquid for the viscosity of the dispersion to be sufficiently low to allow filling mold cavities and replicating the mold surfaces, but not so much liquid as to cause subsequent removal of the liquid from the mold cavity to be prohibitively expensive. In one example, the precursor dispersion includes from 2 percent to 90 percent by weight of the particles that can be converted into ceramic, such as particles of aluminum oxide monohydrate (boehmite), and at least 10 percent by weight, or from 50 percent to 70 percent, or 50 percent to 60 percent, by weight, of the volatile component such as water. Conversely, the precursor dispersion in some embodiments contains from 30 percent to 50 percent, or 40 percent to 50 percent solids by weight.

Examples of suitable precursor dispersions include zirconium oxide sols, vanadium oxide sols, cerium oxide sols, aluminum oxide sols, and combinations thereof. Suitable aluminum oxide dispersions include, for example, boehmite dispersions and other aluminum oxide hydrates dispersions. Boehmite can be prepared by known techniques or can be obtained commercially. Examples of commercially available boehmite include products having the trade designations "DISPERAL" and "DISPAL", both available from Sasol North America, Inc., or "HIQ-40" available from BASF Corporation. These aluminum oxide monohydrates are relatively pure; that is, they include relatively little, if any, hydrate phases other than monohydrates, and have a high surface area.

The physical properties of the resulting shaped abrasive particle 100 or 200 can generally depend upon the type of material used in the precursor dispersion. As used herein, a "gel" is a three-dimensional network of solids dispersed in a liquid.

The precursor dispersion can contain a modifying additive or precursor of a modifying additive. The modifying additive can function to enhance some desirable property of the abrasive particles or increase the effectiveness of the subsequent sintering step. Modifying additives or precursors of modifying additives can be in the form of soluble salts, such as water-soluble salts. They can include a metal-containing compound and can be a precursor of an oxide of magnesium, zinc, iron, silicon, cobalt, nickel, zirconium, hafnium, chromium, yttrium, praseodymium, samarium, ytterbium, neodymium, lanthanum, gadolinium, cerium, dysprosium, erbium, titanium, and mixtures thereof. The particular concentrations of these additives that can be present in the precursor dispersion can be varied.

The introduction of a modifying additive or precursor of a modifying additive can cause the precursor dispersion to gel. The precursor dispersion can also be induced to gel by application of heat over a period of time to reduce the liquid content in the dispersion through evaporation. The precursor dispersion can also contain a nucleating agent. Nucleating agents suitable for this disclosure can include fine particles of alpha alumina, alpha ferric oxide or its precursor, titanium oxides and titanates, chrome oxides, or any other material that will nucleate the transformation. The amount of nucleating agent, if used, should be sufficient to effect the transformation of alpha alumina.

A peptizing agent can be added to the precursor dispersion to produce a more stable hydrosol or colloidal precursor dispersion. Suitable peptizing agents are monoprotic acids or acid compounds such as acetic acid, hydrochloric acid, formic acid, and nitric acid. Multiprotic acids can also be used, but they can rapidly gel the precursor dispersion, making it difficult to handle or to introduce additional components. Some commercial sources of boehmite contain an acid titer (such as absorbed formic or nitric acid) that will assist in forming a stable precursor dispersion.

The precursor dispersion can be formed by any suitable means; for example, in the case of a sol-gel alumina precursor, it can be formed by simply mixing aluminum oxide monohydrate with water containing a peptizing agent or by forming an aluminum oxide monohydrate slurry to which the peptizing agent is added.

Defoamers or other suitable chemicals can be added to reduce the tendency to form bubbles or entrain air while mixing. Additional chemicals such as wetting agents, alcohols, or coupling agents can be added if desired.

A further operation can include providing a mold having at least one mold cavity, or a plurality of cavities formed in at least one major surface of the mold. In some examples, the mold is formed as a production tool, which can be, for example, a belt, a sheet, a continuous web, a coating roll such as a rotogravure roll, a sleeve mounted on a coating roll, or a die. In one example, the production tool can include polymeric material. Examples of suitable polymeric materials include thermoplastics such as polyesters, polycarbonates, poly(ether sulfone), poly(methyl methacrylate), polyurethanes, polyvinylchloride, polyolefin, polystyrene, polypropylene, polyethylene or combinations thereof, or thermosetting materials. In one example, the entire tooling is made from a polymeric or thermoplastic material. In another example, the surfaces of the tooling in contact with the precursor dispersion while the precursor dispersion is drying, such as the surfaces of the plurality of cavities, include polymeric or thermoplastic materials, and other portions of the tooling can be made from other materials. A suitable polymeric coating can be applied to a metal tooling to change its surface tension properties, by way of example.

A polymeric or thermoplastic production tool can be replicated off a metal master tool. The master tool can have the inverse pattern of that desired for the production tool. The master tool can be made in the same manner as the production tool. In one example, the master tool is made out of metal (e.g., nickel) and is diamond-turned. In one example, the master tool is at least partially formed using stereolithography. The polymeric sheet material can be heated along with the master tool such that the polymeric material is embossed with the master tool pattern by pressing the two together. A polymeric or thermoplastic material can also be extruded or cast onto the master tool and then pressed. The thermoplastic material is cooled to solidify and produce the production tool. If a thermoplastic production tool is utilized, then care should be taken not to generate excessive heat that can distort the thermoplastic production tool, limiting its life.

Access to cavities can be from an opening in the top surface or bottom surface of the mold. In some examples, the cavities can extend for the entire thickness of the mold. Alternatively, the cavities can extend only for a portion of the thickness of the mold. In one example, the top surface is substantially parallel to the bottom surface of the mold with the cavities having a substantially uniform depth. At least one side of the mold, the side in which the cavities are formed, can remain exposed to the surrounding atmosphere during the step in which the volatile component is removed.

The cavities have a specified three-dimensional shape to make shaped abrasive particle 100. The depth dimension is equal to the perpendicular distance from the top surface to the lowermost point on the bottom surface. The depth of a given cavity can be uniform or can vary along its length and/or width. The cavities of a given mold can be of the same shape or of different shapes.

A further operation involves filling the cavities in the mold with the precursor dispersion (e.g., by a conventional technique). In some examples, a knife roll coater or vacuum slot die coater can be used. A mold release agent can be used to aid in removing the particles from the mold if desired. Examples of mold release agents include oils such as peanut oil or mineral oil, fish oil, silicones, polytetrafluoroethylene, zinc stearate, and graphite. In general, a mold release agent such as peanut oil, in a liquid, such as water or alcohol, is applied to the surfaces of the production tooling in contact with the precursor dispersion such that from about 0.1 $mg/in^2$ (0.6 $mg/cm^2$) to about 3.0 $mg/in^2$ (20 $mg/cm^2$), or from about 0.1 $mg/in^2$ (0.6 $mg/cm^2$) to about 5.0 $mg/in^2$ (30 $mg/cm^2$), of the mold release agent is present per unit area of the mold when a mold release is desired. In some embodiments, the top surface of the mold is coated with the precursor dispersion. The precursor dispersion can be pumped onto the top surface.

In a further operation, a scraper or leveler bar can be used to force the precursor dispersion fully into the cavity of the mold. The remaining portion of the precursor dispersion that does not enter the cavity can be removed from the top surface of the mold and recycled. In some examples, a small portion of the precursor dispersion can remain on the top surface, and in other examples the top surface is substantially free of the dispersion. The pressure applied by the scraper or leveler bar can be less than 100 psi (0.6 MPa), or less than 50 psi (0.3 MPa), or even less than 10 psi (60 kPa). In some examples, no exposed surface of the precursor dispersion extends substantially beyond the top surface.

In those examples where it is desired to have the exposed surfaces of the cavities result in planar faces of the shaped abrasive particles, it can be desirable to overfill the cavities (e.g., using a micronozzle array) and slowly dry the precursor dispersion.

A further operation involves removing the volatile component to dry the dispersion. The volatile component can be removed by fast evaporation rates. In some examples, removal of the volatile component by evaporation occurs at temperatures above the boiling point of the volatile component. An upper limit to the drying temperature often depends on the material the mold is made from. For polypropylene tooling, the temperature should be less than the melting point of the plastic. In one example, for a water dispersion of from about 40 to 50 percent solids and a polypropylene mold, the drying temperatures can be from about 90° C. to about 165° C., or from about 105° C. to about 150° C., or from about 105° C. to about 120° C. Higher temperatures can lead to improved production speeds but can also lead to degradation of the polypropylene tooling, limiting its useful life as a mold.

During drying, the precursor dispersion shrinks, often causing retraction from the cavity walls. For example, if the cavities have planar walls, then the resulting shaped abrasive particle 100 can tend to have at least three concave major sides. It is presently discovered that by making the cavity walls concave (whereby the cavity volume is increased) it is possible to obtain shaped abrasive particle 100 that have at least three substantially planar major sides. The degree of concavity generally depends on the solids content of the precursor dispersion.

A further operation involves removing resultant precursor shaped abrasive particle 100 from the mold cavities. The precursor shaped abrasive particle 100 or 200 can be removed from the cavities by using the following processes alone or in combination on the mold: gravity, vibration, ultrasonic vibration, vacuum, or pressurized air to remove the particles from the mold cavities.

The precursor shaped abrasive particle 100 or 200 can be further dried outside of the mold. If the precursor dispersion is dried to the desired level in the mold, this additional drying step is not necessary. However, in some instances it can be economical to employ this additional drying step to minimize the time that the precursor dispersion resides in the mold. The precursor shaped abrasive particle 100 or 200 will be dried from 10 to 480 minutes, or from 120 to 400 minutes, at a temperature from 50° C. to 160° C., or 120° C. to 150° C.

A further operation involves calcining the precursor shaped abrasive particle 100 or 200. During calcining, essentially all the volatile material is removed, and the various components that were present in the precursor dispersion are transformed into metal oxides. The precursor shaped abrasive particle 100 or 200 is generally heated to a temperature from 400° C. to 800° C. and maintained within this temperature range until the free water and over 90 percent by weight of any bound volatile material are removed. In an optional step, it can be desirable to introduce the modifying additive by an impregnation process. A water-soluble salt can be introduced by impregnation into the pores of the calcined, precursor shaped abrasive particle 100. Then the precursor shaped abrasive particle 100 are pre-fired again.

A further operation can involve sintering the calcined, precursor shaped abrasive particle 100 or 200 to form particles 100 or 200. In some examples where the precursor includes rare earth metals, however, sintering may not be necessary. Prior to sintering, the calcined, precursor shaped abrasive particle 100 or 200 are not completely densified and thus lack the desired hardness to be used as shaped abrasive particle 100 or 200. Sintering takes place by heating the calcined, precursor shaped abrasive particle 100 or 200 to a temperature of from 1000° C. to 1650° C. The length of time for which the calcined, precursor shaped abrasive particle 100 or 200 can be exposed to the sintering temperature to achieve this level of conversion depends upon various factors, but from five seconds to 48 hours is possible.

In another embodiment, the duration of the sintering step ranges from one minute to 90 minutes. After sintering, the shaped abrasive particle 14 can have a Vickers hardness of 10 GPa (gigaPascals), 16 GPa, 18 GPa, 20 GPa, or greater.

Additional operations can be used to modify the described process, such as, for example, rapidly heating the material from the calcining temperature to the sintering temperature, and centrifuging the precursor dispersion to remove sludge and/or waste. Moreover, the process can be modified by combining two or more of the process steps if desired.

Figure 3A:
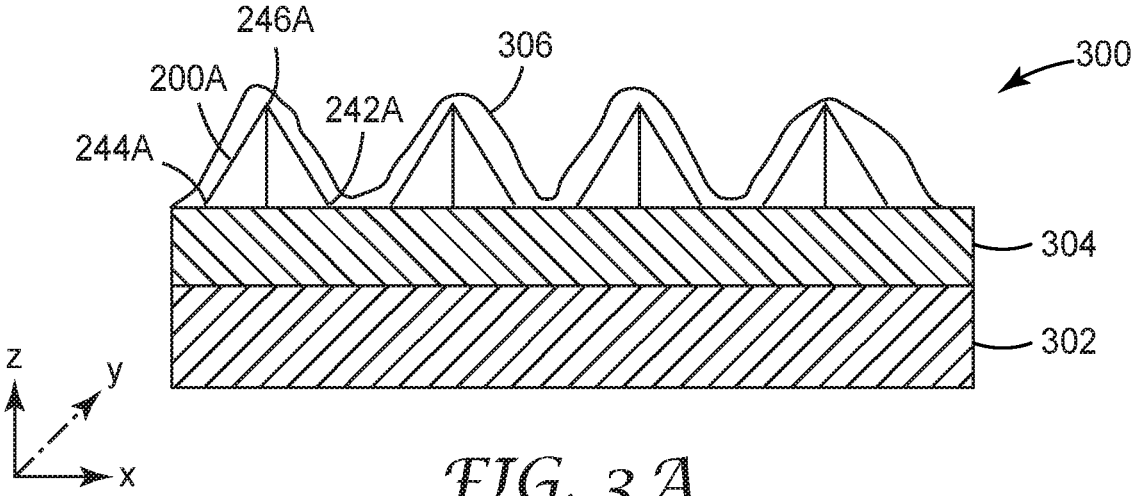
FIGS. 3A and 3B are sectional views of coated abrasive articles, in accordance with various embodiments.

FIG. 3A is a sectional view of coated abrasive article 300. Coated abrasive article 300 includes backing 302 defining a surface along an x-y direction. Backing 302 has a first layer of binder, hereinafter referred to as make coat 304, applied over a first surface of backing 302. Attached or partially embedded in make coat 304 are a plurality of shaped abrasive particles 200A. Although shaped abrasive particles 200A are shown any other shaped abrasive particle described herein can be included in coated abrasive article 300. An optional second layer of binder, hereinafter referred to as size coat 306, is dispersed over shaped abrasive particles 200A. As shown, a major portion of shaped abrasive particles 200A have at least one of three vertices (240, 242, and 244) oriented in substantially the same direction. Thus, shaped abrasive particles 200A are oriented according to a non-random distribution, although in other embodiments any of shaped abrasive particles 200A can be randomly oriented on backing 302. In some embodiments, control of a particle's orientation can increase the cut of the abrasive article.

Backing 302 can be flexible or rigid. Examples of suitable materials for forming a flexible backing include a polymeric film, a metal foil, a woven fabric, a knitted fabric, paper, vulcanized fiber, a staple fiber, a continuous fiber, a nonwoven, a foam, a screen, a laminate, and combinations thereof. Backing 302 can be shaped to allow coated abrasive article 300 to be in the form of sheets, discs, belts, pads, or rolls. In some embodiments, backing 302 can be sufficiently flexible to allow coated abrasive article 300 to be formed into a loop to make an abrasive belt that can be run on suitable grinding equipment.

Make coat 304 secures shaped abrasive particles 200A to backing 302, and size coat 306 can help to reinforce shaped abrasive particles 200A. Make coat 304 and/or size coat 306 can include a resinous adhesive. The resinous adhesive can include one or more resins chosen from a phenolic resin, an epoxy resin, a urea-formaldehyde resin, an acrylate resin, an aminoplast resin, a melamine resin, an acrylated epoxy resin, a urethane resin, a polyester resin, a dying oil, and mixtures thereof.

Figure 3B:
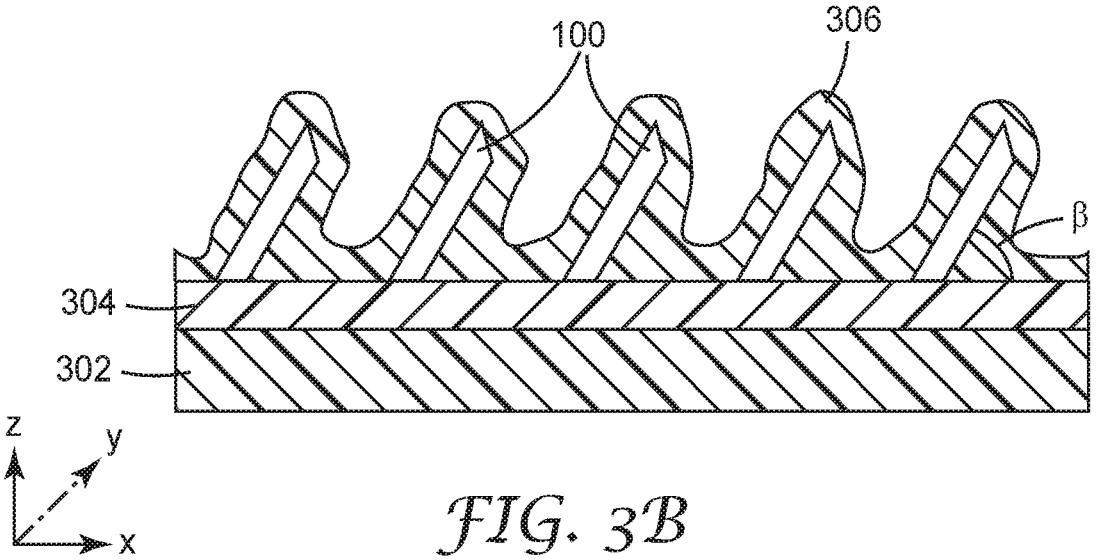

FIG. 3B shows an example of coated abrasive article 300B, which includes shaped abrasive particles 100 instead of shaped abrasive particles 200. As shown, shaped abrasive particles 100 are attached to backing 302 by make coat 304 with size coat 306 applied to further attach or adhere shaped abrasive particles 100 to the backing 302. As shown in FIG. 3B, the majority of the shaped abrasive particles 100 are tipped or leaning to one side. This results in the majority of shaped abrasive particles 100 having an orientation angle β less than 90 degrees relative to backing 302.

Figure 4A:
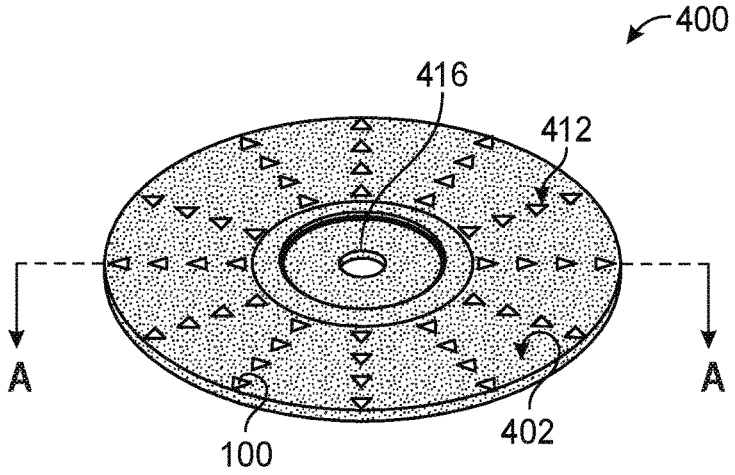
FIGS. 4A-4B are perspective and sectional views of a bonded abrasive article, in accordance with various embodiments.
Figure 4B:
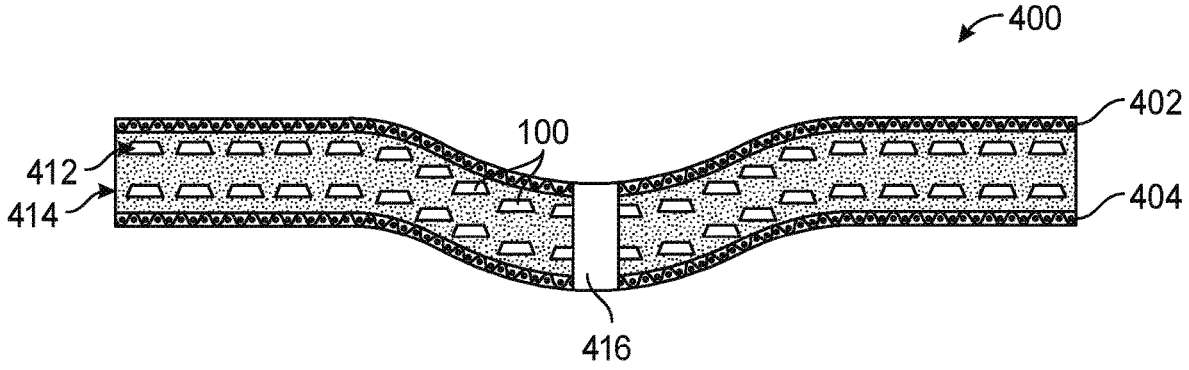
Figure 5:
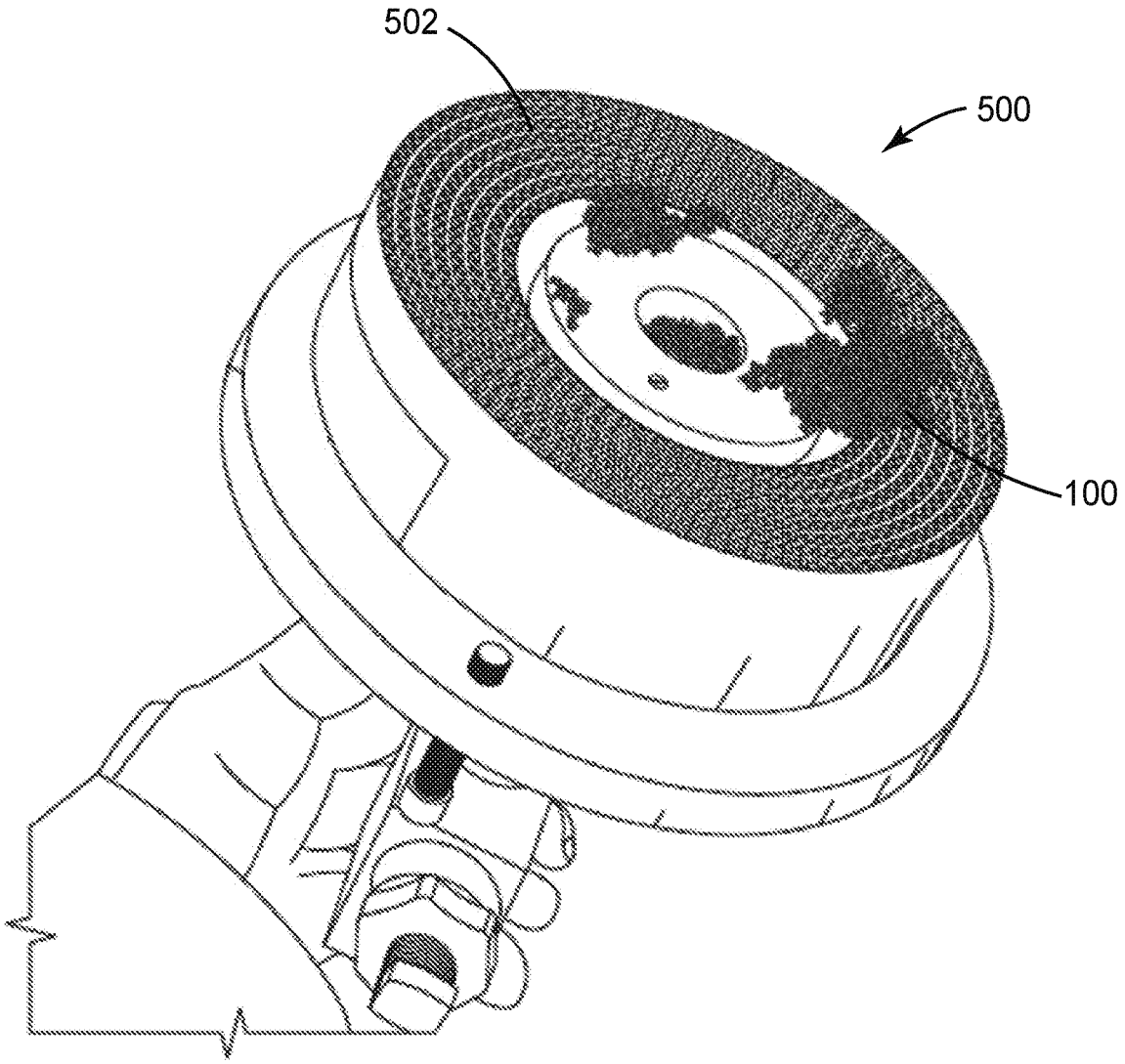
FIGS. 5-8 are perspective views showing various stages of forming a bonded abrasive article, in accordance with various embodiments.

FIGS. 4A and 4B show an example of bonded abrasive article 400. Specifically, FIG. 4A is a perspective view of bonded abrasive article 400 and FIG. 4B is a sectional view of bonded abrasive article 400 taken along line A-A of FIG. 4A. FIGS. 4A and 4B show many of the same features and are discussed concurrently. As depicted, bonded abrasive article 400 is a depressed center grinding wheel. In other examples, the bonded abrasive article can be a cut-off wheel, cutting wheel, a cut-and-grind wheel, a depressed center cut-off wheel, a reel grinding wheel, a mounted point, a tool grinding wheel, a roll grinding wheel, a hot-pressed grinding wheel, a face grinding wheel, a rail grinding wheel, a grinding cone, a grinding plug, a cup grinding wheel, a gear grinding wheel, a centerless grinding wheel, a cylindrical grinding wheel, an inner diameter grinding wheel, an outer diameter grinding wheel, and a double disk grinding wheel. The dimensions of the wheel can be any suitable size for example the diameter can range from 2 cm to about 2000 cm, about 500 cm to about 1000 cm, or less than, equal to, or greater than about 2 cm, 50, 100, 200, 300, 400, 500, 600, 700, 800, 900, 1000, 1100, 1200, 1300, 1400, 1500, 1600, 1700, 1800, 1900, or about 2000 cm.

Bonded abrasive article 400 includes first major surface 402 and second major surface 404. The first major surface and the second major surface have a substantially circular profile. Central aperture 416 extends between first major surface 402 and second major surface 404 and can be used, for example, for attachment to a power driven tool. In examples of other abrasive articles, central aperture 416 can be designed to only extend partially between first and second major surfaces 402 and 404. Bonded abrasive article 400 can be formed from a number of different components.

Although shaped abrasive particles 100 are shown other embodiments of bonded abrasive article 400 can include shaped abrasive particles 200A-200E. The particles present in bonded abrasive article 400 are retained in a binder. As described herein the binder can be an organic resin, a vitreous binder, or a metallic binder. In some examples, the binder can include abrasive particles distributed therein. Suitable organic binders are those that can be cured (e.g., polymerized and/or crosslinked) to form useful organic binders. These binders include, for example, one or more phenolic resins (including novolac and/or resole phenolic resins), one or more epoxy resins, one or more urea-formaldehyde binders, one or more polyester resins, one or more polyimide resins, one or more rubbers, one or more polybenzimidazole resins, one or more shellacs, one or more acrylic monomers and/or oligomers, and combinations thereof. The organic binder precursor(s) may be combined with additional components such as, for example, curatives, hardeners, catalysts, initiators, colorants, antistatic agents, grinding aids, and lubricants.

Useful phenolic resins include novolac and resole phenolic resins. Novolac phenolic resins are characterized by being acid-catalyzed and as having a ratio of formaldehyde to phenol of less than one, for example, between 0.5:1 and 0.8:1. Resole phenolic resins are characterized by being alkaline catalyzed and having a ratio of formaldehyde to phenol of greater than or equal to one, for example from 1:1 to 3:1. Novolac and resole phenolic resins may be chemically modified (e.g., by reaction with epoxy compounds), or they may be unmodified. Exemplary acidic catalysts suitable for curing phenolic resins include sulfuric, hydrochloric, phosphoric, oxalic, and p-toluenesulfonic acids. Alkaline catalysts suitable for curing phenolic resins include sodium hydroxide, barium hydroxide, potassium hydroxide, calcium hydroxide, organic amines, or sodium carbonate.

Phenolic resins are well-known and readily available from commercial sources. Examples of commercially available novolac resins include DUREZ 1364, a two-step, powdered phenolic resin (marketed by Durez Corporation, Addison, Tex., under the trade designation VARCUM (e.g., 29302), or DURITE RESIN AD-5534 (marketed by Hexion, Inc., Louisville, KY). Examples of commercially available resole phenolic resins useful in practice of the present disclosure include those marketed by Durez Corporation under the trade designation VARCUM (e.g., 29217, 29306, 29318, 29338, 29353); those marketed by Ashland Chemical Co., Bartow, Fla. under the trade designation AEROFENE (e.g., AEROFENE 295); and those marketed by Kangnam Chemical Company Ltd., Seoul, South Korea under the trade designation "PHENOLITE" (e.g., PHENOLITE TD-2207).

With regards to vitrified binding materials, vitreous bonding materials, which exhibit an amorphous structure and are hard, are well known in the art. In some cases, the vitreous bonding material includes crystalline phases. Examples of metal oxides that are used to form vitreous bonding materials include: silica, silicates, alumina, soda, calcia, potassia, titania, iron oxide, zinc oxide, lithium oxide, magnesia, boria, aluminum silicate, borosilicate glass, lithium aluminum silicate, combinations thereof, and the like. Vitreous bonding materials can be formed from a composition comprising from 10 to 100% glass frit, although more typically the composition comprises 20% to 80% glass frit, or 30% to 70% glass frit. The remaining portion of the vitreous bonding material can be a non-frit material. Alternatively, the vitreous bond may be derived from a non-frit containing composition. Vitreous bonding materials are typically matured at a temperature(s) in the range from about 700° C. to about 1500° C., usually in the range from about 800° C. to about 1300° C., sometimes in the range from about 900° C. to about 1200° C., or even in the range from about 950° C. to about 1100° C. The actual temperature at which the bond is matured depends, for example, on the particular bond chemistry. Preferred vitrified bonding materials may include those comprising silica, alumina (preferably, at least 10 percent by weight alumina), and boria (preferably, at least 10 percent by weight boria). In most cases the vitrified bonding materials further comprise alkali metal oxide(s) (e.g., Na2O and K2O) (in some cases at least 10 percent by weight alkali metal oxide(s)).

Shaped abrasive particles 100 can be arranged in a plurality of layers. For example, as shown in FIGS. 4A and 4B bonded abrasive article 400 includes first layer of shaped abrasive particles 412 and second layer of shaped abrasive particles 414. First layer of shaped abrasive particles 412 and the second layer of shaped abrasive particles 414 are spaced apart from one another with the binder located therebetween. Although two layers are shown, bonded abrasive article 400 can include additional layers of shaped abrasive particles 100. For example, bonded abrasive article 400 can include a third layer of shaped abrasive particles 100 adjacent to at least one of the first or second layers of triangular abrasive particles 412 and 414. Any of layers 412 and 414 can include crushed abrasive particles, ceramic crushed abrasive particles, or ceramic shaped abrasive particles.

Although shaped abrasive particles 100, can be randomly distributed it is also possible to distribute shaped abrasive particles 100 according to a predetermined pattern. For example, FIG. 4A shows a pattern where adjacent shaped abrasive particles 100 of first layer 412 are directly aligned with each other in rows extending from central aperture 416 to the perimeter of bonded abrasive article 400. Adjacent shaped abrasive particles 100 are also directly aligned in concentric circles. Alternatively, adjacent shaped abrasive particles 100 can be staggered with respect to each other. Additional predetermined patterns of shaped abrasive particles 100 are also within the scope of this disclosure. For example, shaped abrasive particles 100 can be arranged in a pattern that forms a word or image. Shaped abrasive particles 100 can also be arranged in a pattern that forms an image when bonded abrasive article 400 is rotated at a predetermined speed. In addition to, or instead of, shaped abrasive particles 100 being arranged in a predetermined pattern, other particles such as filler particles can also be arranged in a predetermined pattern as described with respect to the abrasive particles.

Abrasive article 300 or 400 can also include conventional (e.g., crushed) abrasive particles. Examples of useful abrasive particles include fused aluminum oxide-based materials such as aluminum oxide, ceramic aluminum oxide (which can include one or more metal oxide modifiers and/or seeding or nucleating agents), and heat-treated aluminum oxide, silicon carbide, co-fused alumina-zirconia, diamond, ceria, titanium diboride, cubic boron nitride, boron carbide, garnet, flint, emery, sol-gel derived abrasive particles, and mixtures thereof.

The conventional abrasive particles can, for example, have an average diameter ranging from about 10 μm to about 2000 μm, about 20 μm to about 1300 μm, about 50 μm to about 1000 μm, less than, equal to, or greater than about 10 μm, 20, 30, 40, 50, 100, 150, 200, 250, 300, 350, 400, 450, 500, 550, 600, 650, 700, 750, 800, 850, 900, 950, 1000, 1050, 1100, 1150, 1200, 1250, 1300, 1350, 1400, 1450, 1500, 1550, 1650, 1700, 1750, 1800, 1850, 1900, 1950, or 2000 μm. For example, the conventional abrasive particles can have an abrasives industry-specified nominal grade. Such abrasives industry-accepted grading standards include those known as the American National Standards Institute, Inc. (ANSI) standards, Federation of European Producers of Abrasive Products (FEPA) standards, and Japanese Industrial Standard (HS) standards. Exemplary ANSI grade designations (e.g., specified nominal grades) include: ANSI 12 (1842 μm), ANSI 16 (1320 μm), ANSI 20 (905 μm), ANSI 24 (728 μm), ANSI 36 (530 μm), ANSI 40 (420 μm), ANSI 50 (351 μm), ANSI 60 (264 μm), ANSI 80 (195 μm), ANSI 100 (141 μm), ANSI 120 (116 μm), ANSI 150 (93 μm), ANSI 180 (78 μm), ANSI 220 (66 μm), ANSI 240 (53 μm), ANSI 280 (44 μm), ANSI 320 (46 μm), ANSI 360 (30 μm), ANSI 400 (24 μm), and ANSI 600 (16 μm). Exemplary FEPA grade designations include P12 (1746 μm), P16 (1320 μm), P20 (984 μm), P24 (728 μm), P30 (630 μm), P36 (530 μm), P40 (420 μm), P50 (326 μm), P60 (264 μm), P80 (195 μm), P100 (156 μm), P120 (127 μm), P120 (127 μm), P150 (97 μm), P180 (78 μm), P220 (66 μm), P240 (60 μm), P280 (53 μm), P320 (46 μm), P360 (41 μm), P400 (36 μm), P500 (30 μm), P600 (26 μm), and P800 (22 μm). An approximate average particles size of reach grade is listed in parenthesis following each grade designation.

Shaped abrasive particles 100 or 200 or crushed abrasive particles can include any suitable material or mixture of materials. For example, shaped abrasive particles 100 can include a material chosen from an alpha-alumina, a fused aluminum oxide, a heat-treated aluminum oxide, a ceramic aluminum oxide, a sintered aluminum oxide, a silicon carbide, a titanium diboride, a boron carbide, a tungsten carbide, a titanium carbide, a diamond, a cubic boron nitride, a garnet, a fused alumina-zirconia, a sol-gel derived abrasive particle, a cerium oxide, a zirconium oxide, a titanium oxide, and combinations thereof. In some embodiments, shaped abrasive particles 100 or 200 and crushed abrasive particles can include the same materials. In further embodiments, shaped abrasive particles 100 or 200 and crushed abrasive particles can include different materials.

Filler particles can also be included in abrasive articles 200 or 300. Examples of useful fillers include metal carbonates (such as calcium carbonate, calcium magnesium carbonate, sodium carbonate, magnesium carbonate), silica (such as quartz, glass beads, glass bubbles and glass fibers), silicates (such as talc, clays, montmorillonite, feldspar, mica, calcium silicate, calcium metasilicate, sodium aluminosilicate, sodium silicate), metal sulfates (such as calcium sulfate, barium sulfate, sodium sulfate, aluminum sodium sulfate, aluminum sulfate), gypsum, vermiculite, sugar, wood flour, a hydrated aluminum compound, carbon black, metal oxides (such as calcium oxide, aluminum oxide, tin oxide, titanium dioxide), metal sulfites (such as calcium sulfite), thermoplastic particles (such as polycarbonate, polyetherimide, polyester, polyethylene, poly(vinylchloride), polysulfone, polystyrene, acrylonitrile-butadiene-styrene block copolymer, polypropylene, acetal polymers, polyurethanes, nylon particles) and thermosetting particles (such as phenolic bubbles, phenolic beads, polyurethane foam particles and the like). The filler may also be a salt such as a halide salt. Examples of halide salts include sodium chloride, potassium cryolite, sodium cryolite, ammonium cryolite, potassium tetrafluoroborate, sodium tetrafluoroborate, silicon fluorides, potassium chloride, magnesium chloride. Examples of metal fillers include, tin, lead, bismuth, cobalt, antimony, cadmium, iron and titanium. Other miscellaneous fillers include sulfur, organic sulfur compounds, graphite, lithium stearate and metallic sulfides. In some embodiments, individual shaped abrasive particles 100 or individual crushed abrasive particles can be at least partially coated with an amorphous, ceramic, or organic coating. Examples of suitable components of the coatings include, a silane, glass, iron oxide, aluminum oxide, or combinations thereof. Coatings such as these can aid in processability and bonding of the particles to a resin of a binder.

Abrasive article 400 can be formed according to any suitable method. One method includes retaining a first plurality of shaped abrasive particles 100 within a first portion of the plurality of holes 502 of apparatus 500. Apparatus 500 can be positioned within a mold and the first plurality of shaped abrasive particles 100 are released in the mold. Binder material is then deposited to form a mixture of shaped abrasive particles 100 and binder material. The mold can then be heated to form the abrasive article.

Figure 16A:
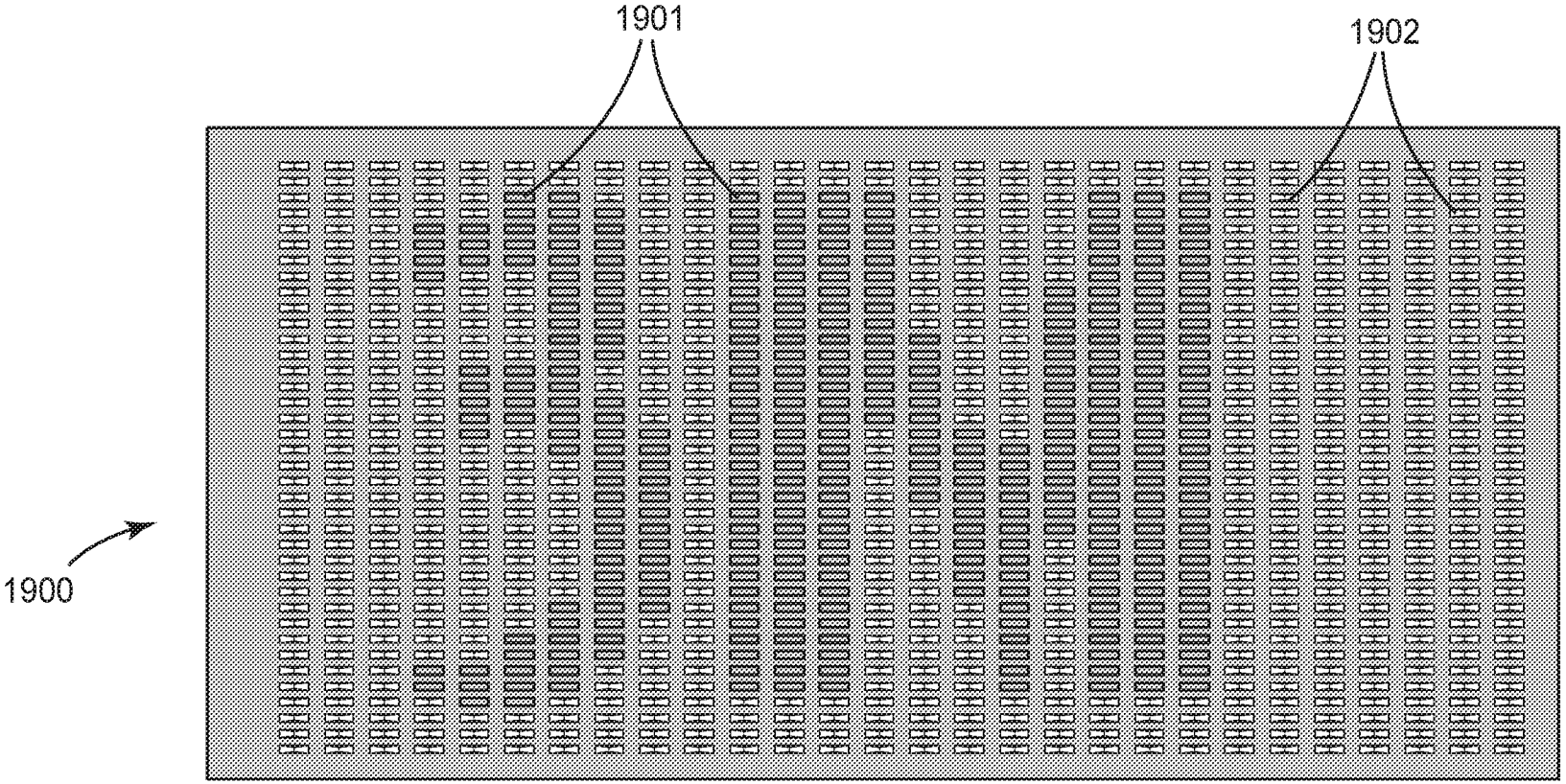
FIG. 16A is a schematic top view of an exemplary mold having at least two pluralities of holes according to various embodiments.
Figure 16B:
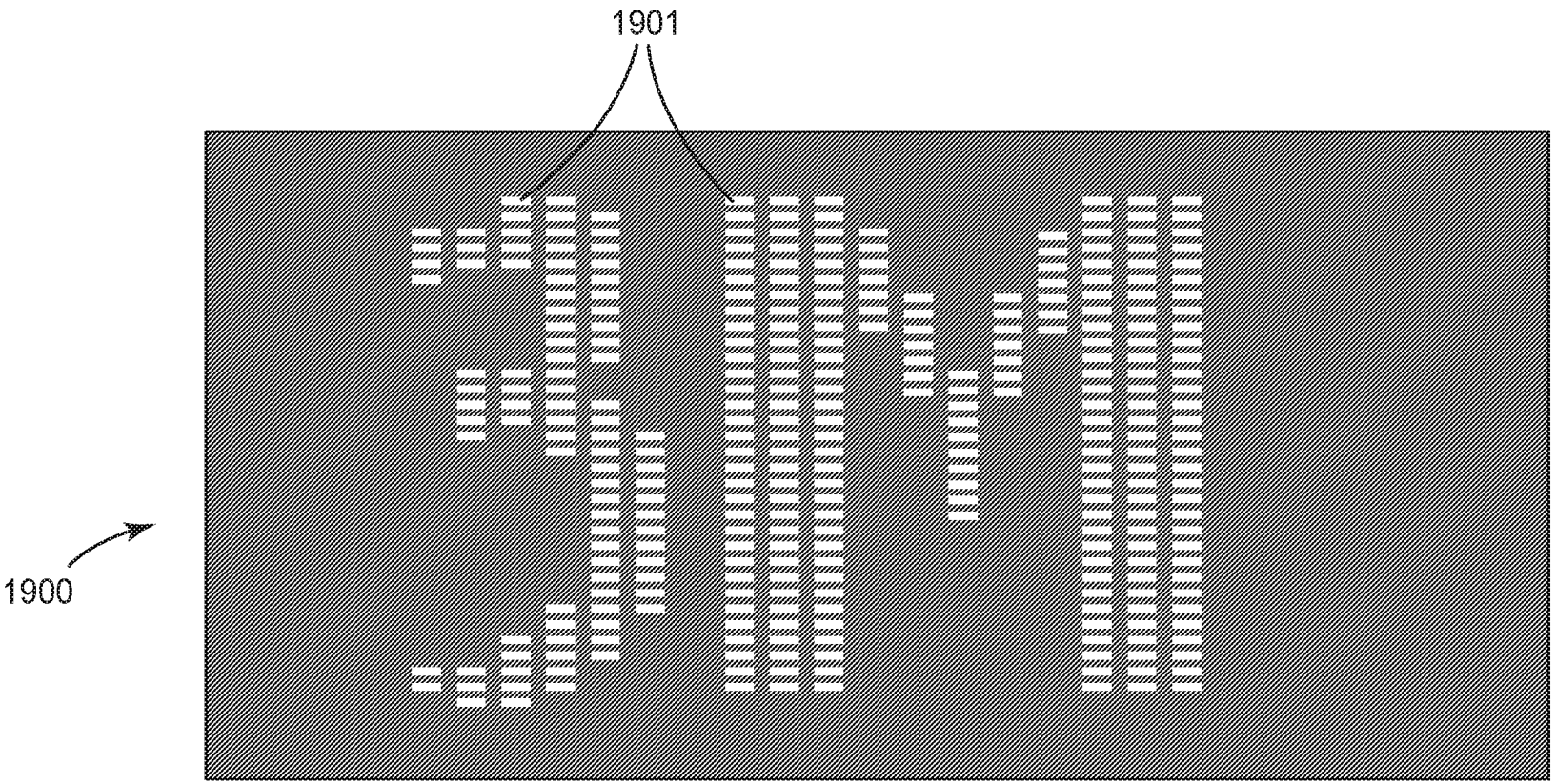
FIG. 16B is a schematic top view of an exemplary mold having at least two pluralities of holes according to various embodiments.
Figure 17:
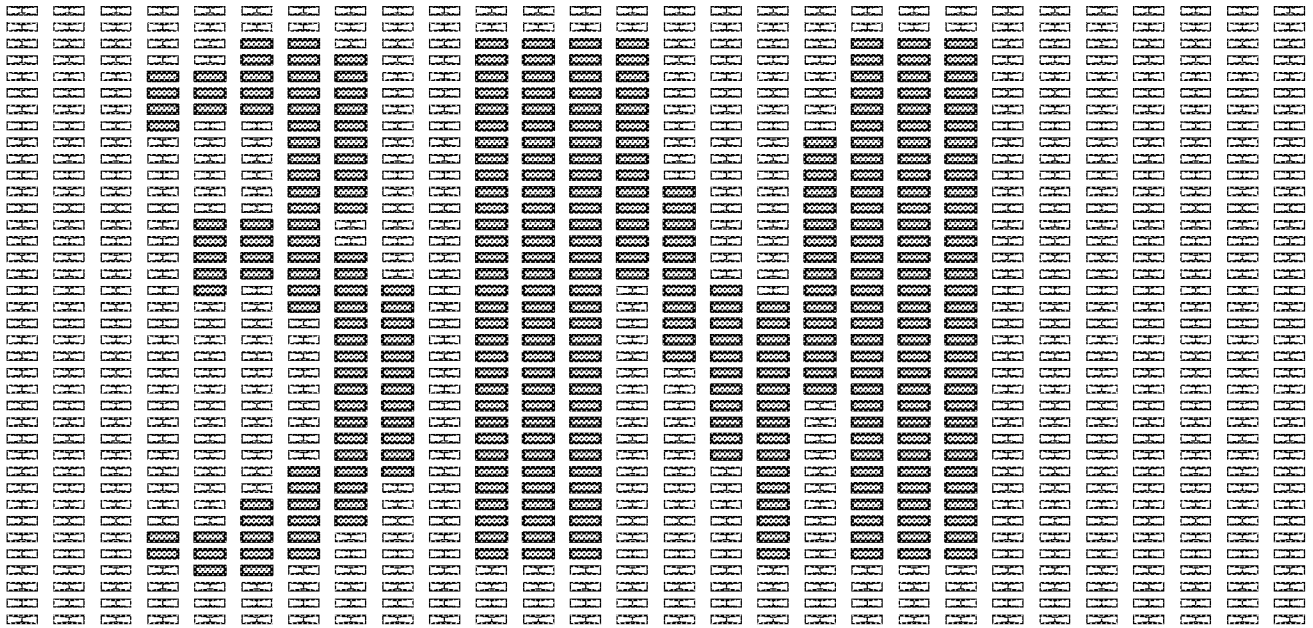
FIG. 17 is a schematic top view of an exemplary abrasive article made by using the mold shown as in FIGS. 16A and 16B according to various embodiments.

In some embodiments, an abrasive article includes at least two pluralities of abrasive particles. Each plurality of abrasive particles can be different in shapes, sizes, compositions, colors, hardness, or any other characteristics from another plurality of abrasive particles. At least one plurality of particles can be aligned in pre-determined patterns to form one or more symbols in the final abrasive article. The abrasive article can be made according to any suitable method. In one embodiment, more than one pluralities of holes are included in the mold. Each plurality of holes can be different in any characteristics, such as, but not limited to, shape, size, or dimensions, from another plurality of holes. First plurality of abrasive particles can be positioned in the first plurality of holes in the mold, second plurality of abrasive particles can be positioned in the second plurality of holes, and likewise for any additional plurality of abrasive particles. For example, as shown in FIGS. 16A and 16B, the mold 1900 includes two pluralities of holes, a first plurality of holes 1901 and a second plurality of holes 1902. The mold 1900 have a top surface and a bottom surface opposing to the top surface. The first plurality of holes 1901 have openings from the top surface of the mold through the bottom surface of the mold 1900, so that the holes 1901 can extend for the entire thickness of the mold 1900. The second plurality of holes 1902 are cavities having openings only on the top surface of the mold 1900. The first plurality of abrasive particles can be positioned to fill the first plurality of holes 1901 from the bottom surface of the mold. While the first plurality of holes 1901 are occupied by the first plurality of abrasive particles, the second plurality of abrasive particles can be positioned to fill the second plurality of holes 1902 from the top surface of the mold 1900. The method can further include removing abrasive particles that are not in respective cavities off the mold 1900. The method can further include depositing the abrasive particles into at least one binding material. This exemplary method can form an abrasive article as shown in FIG. 17. Other methods could also be used for making an abrasive article, for examples, methods according to the disclosure in U.S. Patent Application Nos. 62/781,037, 62/781,103 and 62/825,938.

The first portion of the plurality of holes 502 can range from about 5% to about 100% of the total amount of holes 502 of apparatus 500, or from about 30% to about 60%, or less than about, equal to about, or greater than about 10%, 15, 20, 25, 30, 35, 40, 45, 50, 55, 60, 65, 70, 75, 80, 85, 90, or 95%. In examples where the first portion of the plurality of holes 502 is less than 100%, a second plurality of shaped abrasive particles 100 can be retained within a second portion of the plurality of holes of the apparatus. The second portion of the plurality of holes 502 can range from about 5% to about 99% of the total amount of holes of the apparatus, or from about 30% to about 60%, or less than about, equal to about, or greater than about 10%, 15, 20, 25, 30, 35, 40, 45, 50, 55, 60, 65, 70, 75, 80, 85, 90, or 95%.

Figure 6:
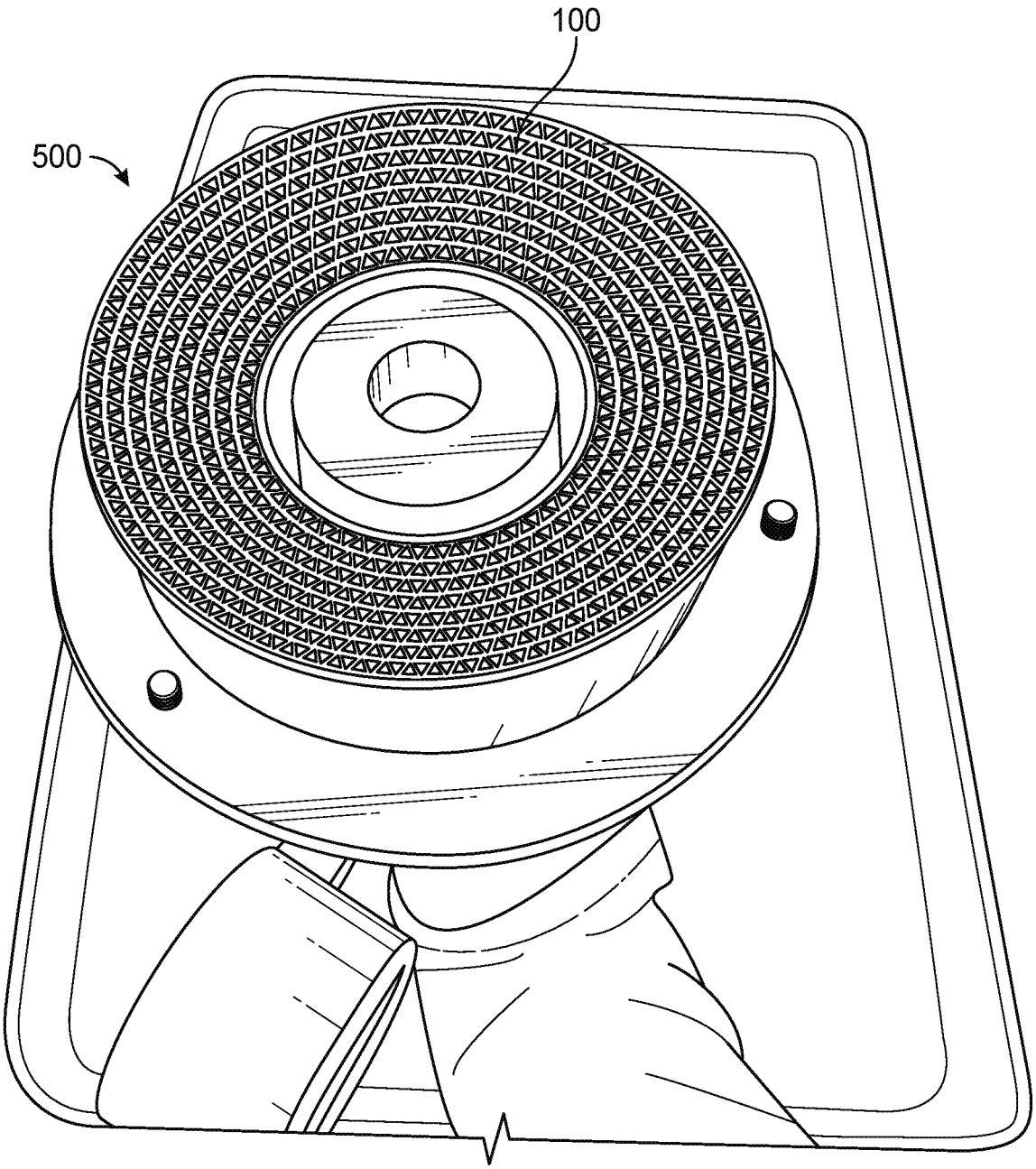

FIG. 6 is a perspective view showing the apparatus in which a first plurality of shaped abrasive particles 100 is contacting the apparatus first major surface. Shaped abrasive particles 100 can be contacted with the apparatus first major surface by pouring the particles 100 over the apparatus or by immersing the apparatus in the abrasive particles.

The vacuum generation system is engaged after a majority (e.g., around 95%) of holes 502 of the apparatus are filled with abrasive particles 100 the vacuum generation system is engaged. This results in the pressure inside the housing being decreased. FIG. 6 is a perspective view showing shaped abrasive particles 100 retained in the holes of the apparatus once the vacuum is engaged. Alternatively, the particles 100 could be retained through activation of a magnet within the housing.

Figure 7:
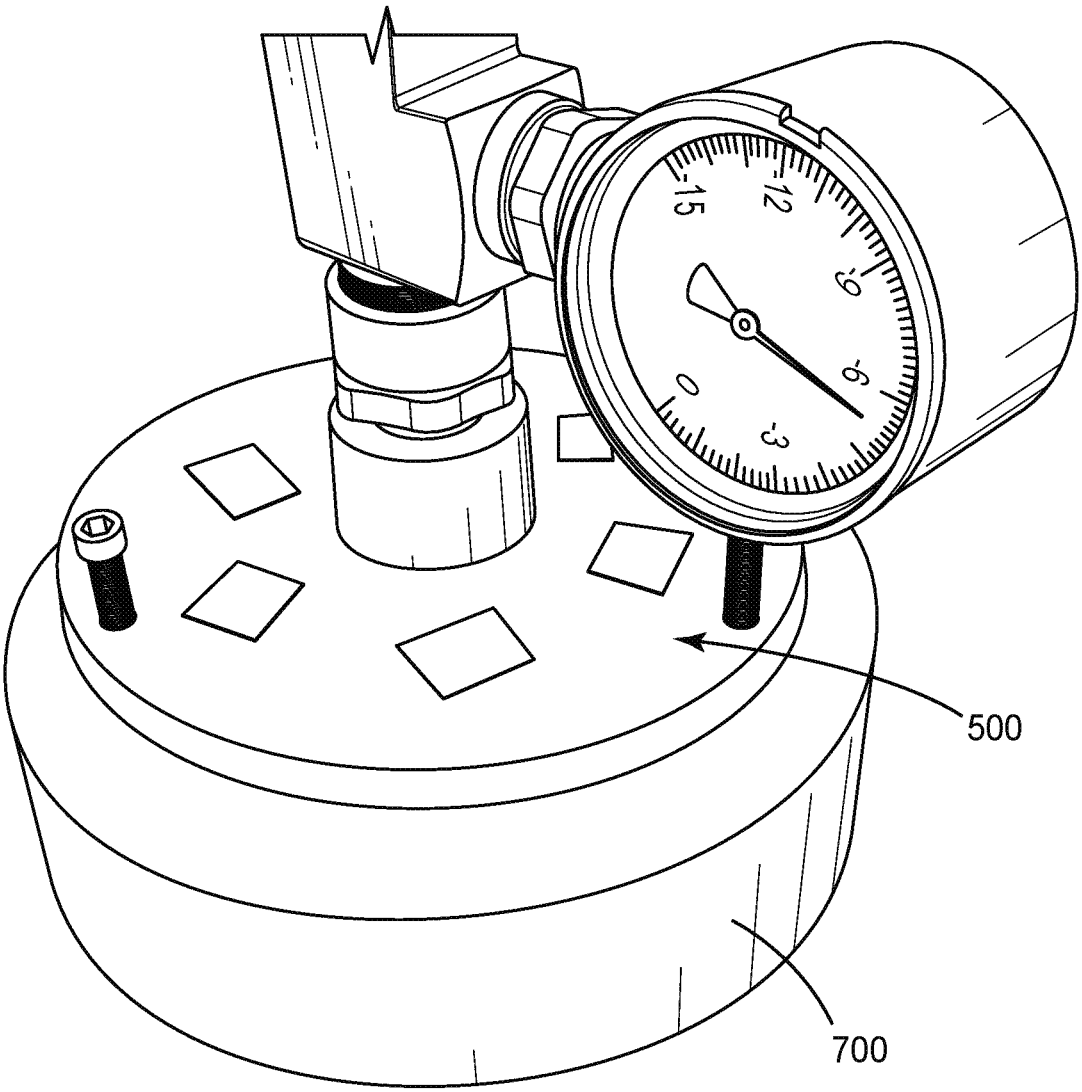
Figure 8:
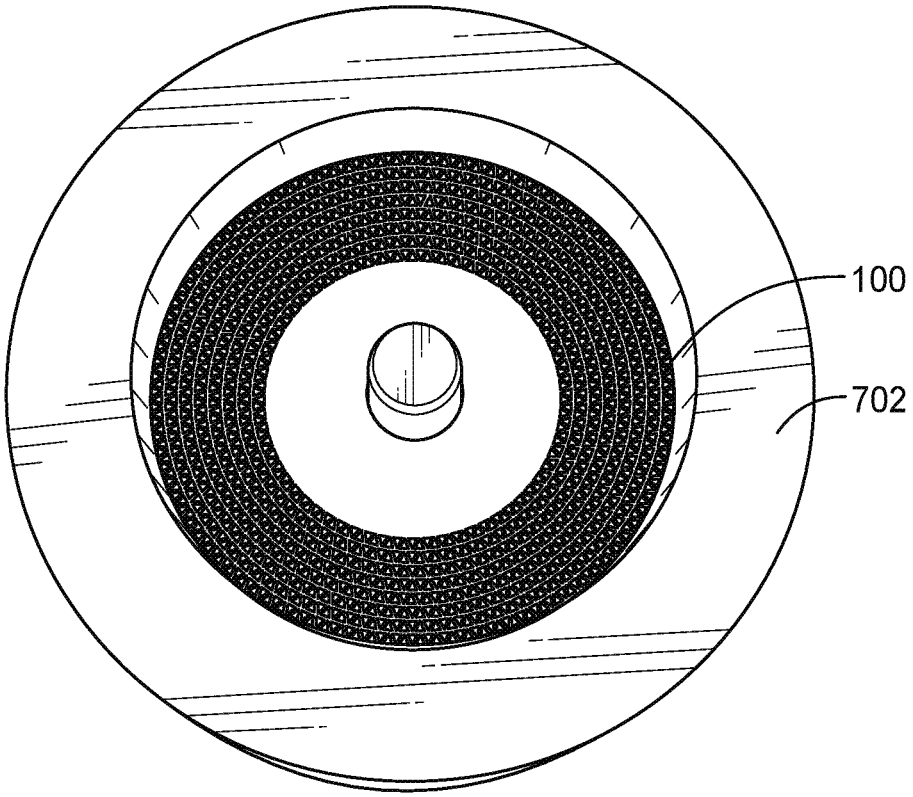

FIG. 7 is a perspective view showing apparatus 500 positioned within mold 700. Once the is adequately positioned within mold 700 abrasive particles 100 are released. The release of abrasive particles 100 can be accomplished by increasing the pressure within the housing or disengaging the magnet. A majority of abrasive particles 100 are released into mold 700 upon the increase in pressure or disengagement of the magnet. The particles can be released substantially simultaneously or over a time period ranging up to about 10 seconds. FIG. 8 is a perspective view showing abrasive particles 100 in mold after release. Upon release, abrasive particles 100 contact any binder material predisposed in the mold 700. If there is no binder material in mold 700, then binder material can be added after abrasive particles 100 or 200 are deposited in mold 700. The abrasive particles and the binder form a mixture. The mixture can optionally be pressed.

Because at least a majority of holes 502 in apparatus 500 are arranged in a predetermined pattern at least a majority of abrasive particles 100 are deposited in mold 700 in a predetermined pattern. Thus, to form a predetermined pattern of abrasive particles 100, it is not necessary to attach the particles to a reinforcing layer such as a scrim or to arrange the particles in a scaffold structure that is incorporated into the abrasive article. Additional layers of abrasive particles can be formed by reloading the apparatus and depositing additional layers of abrasive particles in the mold on top of a previously deposited layer of abrasive particles.

After the desired amount of layers of abrasive particles 100 are deposited in mold 700, the mixture is cured by heating at, for example, temperatures ranging from about 70° C. to about 200° C. The mixture is heated for a sufficient time to cure the curable phenolic resins. For example, suitable times can range from about 2 hours to about 40 hours. Curing can also be done in a stepwise fashion; for example, the wheel can be heated to a first temperature ranging from about 70° C. to about 95° C. for a time ranging from about 2 hours to about 40 hours. The mixture can then be heated at a second temperature ranging from about 100° C. to about 125° C. for a time ranging from about 2 hours to about 40 hours. The mixture can then be heated at a third temperature ranging from about 140° C. to about 200° C. for a time ranging from about 2 hours to about 10 hours. The mixture can be cured in the presence of air. Alternatively, to help preserve any color, the wheel can be cured at a higher temperature (e.g., greater than 140° C.) under nitrogen where the concentration of oxygen is relatively low.

As shown in FIGS. 3A and 3B each of the plurality of shaped abrasive particles 100 or 200 can have a specified z-direction rotational orientation about a z-axis passing through shaped abrasive particles 100 or 200 and through backing 302 at a 90 degree angle to backing 302. Shaped abrasive particles 100 or 200 are orientated with a surface feature, such as a substantially planar surface particle 100 or 200, rotated into a specified angular position about the z-axis. The specified z-direction rotational orientation abrasive article 300A or 300B occurs more frequently than would occur by a random z-directional rotational orientation of the surface feature due to electrostatic coating or drop coating of the shaped abrasive particles 100 or 200 when forming the abrasive article 300A or 300B. As such, by controlling the z-direction rotational orientation of a significantly large number of shaped abrasive particles 100 or 200, the cut rate, finish, or both of coated abrasive article 300A or 300B can be varied from those manufactured using an electrostatic coating method. In various embodiments, at least 50, 51, 55, 60, 65, 70, 75, 80, 85, 90, 95, or 99 percent of shaped abrasive particles 100 or 200 can have a specified z-direction rotational orientation which does not occur randomly and which can be substantially the same for all of the aligned particles. In other embodiments, about 50 percent of shaped abrasive particles 100 or 200 can be aligned in a first direction and about 50 percent of shaped abrasive particles 100 or 200 can be aligned in a second direction. In one embodiment, the first direction is substantially orthogonal to the second direction.

The specific z-direction rotational orientation of formed abrasive particles can be achieved through use of a precision apertured screen that positions shaped abrasive particles 100 or 200 into a specific z-direction rotational orientation such that shaped abrasive particle 100 or 200 can only fit into the precision apertured screen in a few specific orientations such as less than or equal to 4, 3, 2, or 1 orientations. For example, a rectangular opening just slightly bigger than the cross section of shaped abrasive particle 100 or 200 comprising a rectangular plate will orient shaped abrasive particle 100 or 200 in one of two possible 180 degree opposed z-direction rotational orientations. The precision apertured screen can be designed such that shaped abrasive particles 100 or 200, while positioned in the screen's apertures, can rotate about their z-axis (normal to the screen's surface when the formed abrasive particles are positioned in the aperture) less than or equal to about 30, 20, 10, 5, 2, or 1 angular degrees.

The precision apertured screen having a plurality of apertures selected to z-directionally orient shaped abrasive particles 100 and 200 into a pattern, can have a retaining member such as adhesive tape on a second precision apertured screen with a matching aperture pattern, an electrostatic field used to hold the particles in the first precision screen or a mechanical lock such as two precision apertured screens with matching aperture patterns twisted in opposite directions to pinch particles 100 and 200 within the apertures. The first precision aperture screen is filled with shaped abrasive particles 100 and 200, and the retaining member is used to hold shaped abrasive particles 100 in place in the apertures. In one embodiment, adhesive tape on the surface of a second precision aperture screen aligned in a stack with the first precision aperture screen causes shaped abrasive particles 100 to stay in the apertures of the first precision screen stuck to the surface of the tape exposed in the second precision aperture screen's apertures.

Following positioning in apertures, coated backing 302 having make layer 304 is positioned parallel to the first precision aperture screen surface containing the shaped abrasive particles 100 or 200 with make layer 304 facing shaped abrasive particles 100 or 200 in the apertures. Thereafter, coated backing 302 and the first precision aperture screen are brought into contact to adhere shaped abrasive particles 100 or 200 to the make layer. The retaining member is released such as removing the second precision aperture screen with taped surface, untwisting the two precision aperture screens, or eliminating the electrostatic field. Then the first precision aperture screen is then removed leaving the shaped abrasive particles 100 or 200 having a specified z-directional rotational orientation on the coated abrasive article 300 for further conventional processing such as applying a size coat and curing the make and size coats.

Figure 9:
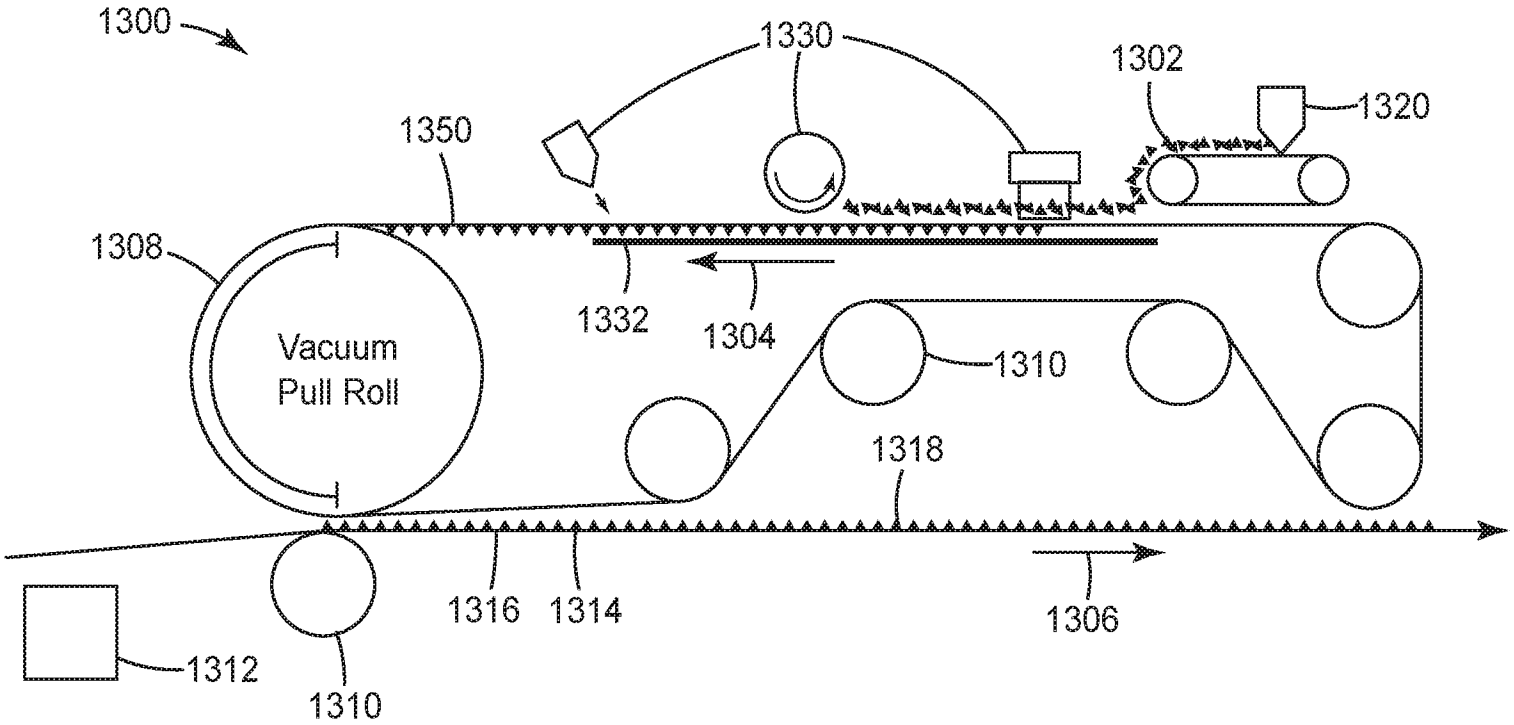
FIG. 9 is a schematic diagram showing a system for manufacturing abrasive articles in accordance with various embodiments.
Figure 10:
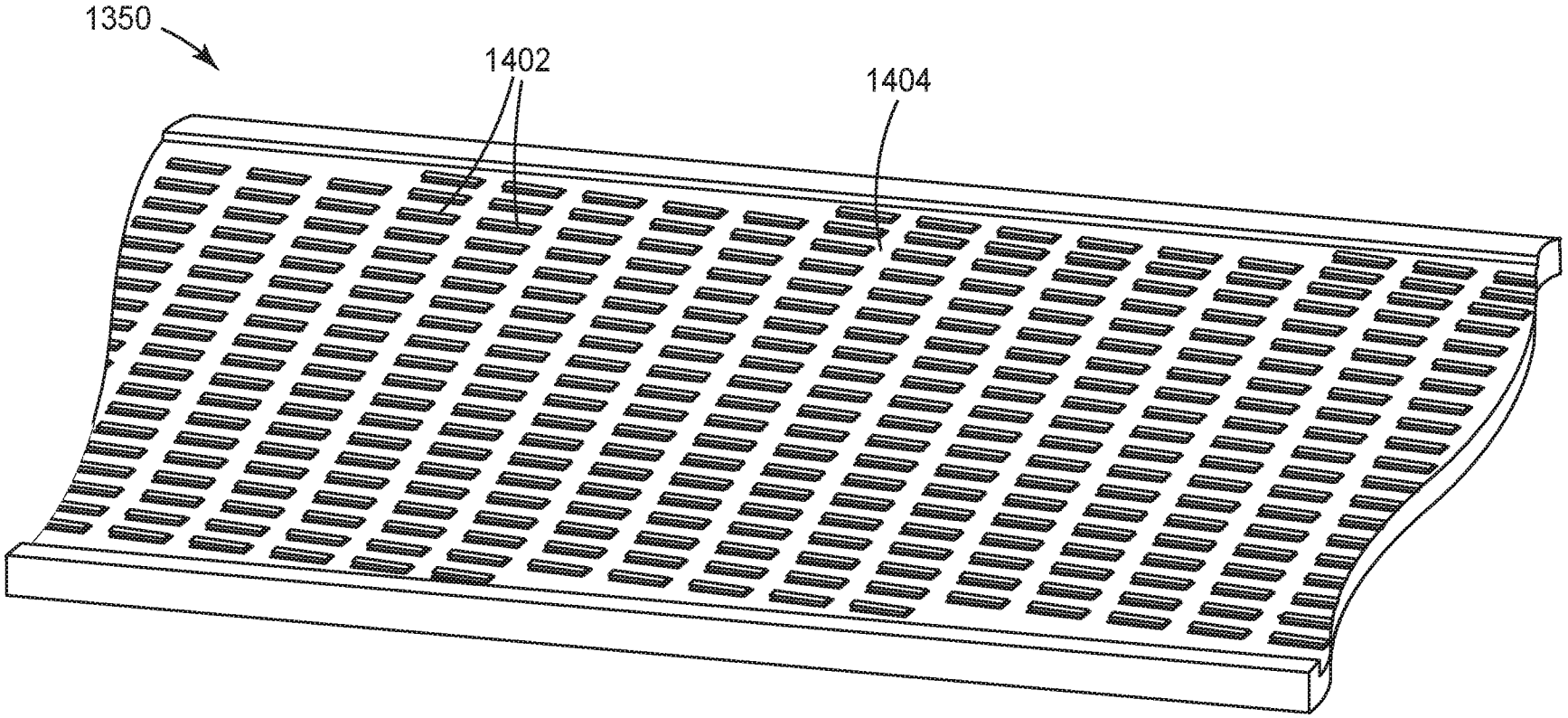
FIG. 10 is a section of tooling from the system of FIG. 13 in accordance with various embodiments.

Another tool and method to form abrasive article 300 in which shaped abrasive particles 100 or 200 have a specified z-direction rotational angle is to use the system shown in FIGS. 9 and 10. In FIGS. 9 and 10, coated abrasive article system 1300 according to the present disclosure includes shaped abrasive particles 1302 removably disposed within cavities 1402 of production tool 1350 having first web path 1304 guiding production tool 1350 through system 1300 such that it wraps a portion of an outer circumference of shaped abrasive particle transfer roll 1308. System 1300 can include, for example, idler rollers 1310 and make coat delivery system 1312. These components unwind backing 1314, deliver make coat resin 1316 via make coat delivery system 1312 to a make coat applicator and apply make coat resin to first major surface 1318 of backing 1314. Thereafter resin coated backing 1314 is positioned by an idler roll 1310 for application of shaped abrasive particles 1302 to the first major surface 1318 coated with make coat resin 1316. Second web path 1306 for resin coated backing 1314 passes through the system 1300 such that the resin layer is positioned facing a dispensing surface 1404 (FIG. 10) of production tool 1350 that is positioned between resin coated backing 1314 and an outer circumference of the shaped abrasive particle transfer roll 1308. Suitable unwinds, make coat delivery systems, make coat resins, coaters and backings are known to those of skill in the art. Make coat delivery system 1312 can be a simple pan or reservoir containing the make coat resin or a pumping system with a storage tank and delivery plumbing to translate make coat resin 1316 to a needed location. Backing 1314 can be a cloth, paper, film, nonwoven, scrim, or other web substrate. Make coat applicator 1312 can be, for example, a coater, a roll coater, a spray system, a die coater, or a rod coater. Alternatively, a precoated coated backing can be positioned by an idler roll 1310 for application of shaped abrasive particles 1302 to the first major surface.

As shown in FIG. 10, production tool 1350 comprises a plurality of cavities 1402 having a complimentary shape to intended shaped abrasive particle 1302 to be contained therein. Shaped abrasive particle feeder 1320 supplies at least some shaped abrasive particles 1302 to production tool 1350. Shaped abrasive particle feeder 1320 can supply an excess of shaped abrasive particles 1302 such that there are more shaped abrasive particles 1302 present per unit length of production tool in the machine direction than cavities 1402 present. Supplying an excess of shaped abrasive particles 1302 helps to ensure that a desired amount of cavities 1402 within the production tool 1350 are eventually filled with shaped abrasive particle 1302. Since the bearing area and spacing of shaped abrasive particles 1302 is often designed into production tooling 1350 for the specific grinding application it is desirable to not have too many unfilled cavities 1402. Shaped abrasive particle feeder 1320 can be the same width as the production tool 1350 and can supply shaped abrasive particles 1302 across the entire width of production tool 1350. Shaped abrasive particle feeder 1320 can be, for example, a vibratory feeder, a hopper, a chute, a silo, a drop coater, or a screw feeder.

Optionally, filling assist system 1330 is provided after shaped abrasive particle feeder 1320 to move shaped abrasive particles 1302 around on the surface of production tool 1350 and to help orientate or slide shaped abrasive particles 1302 into the cavities 1402. Filling assist system 1330 can be, for example, a doctor blade, a felt wiper, a brush having a plurality of bristles, a vibration system, a blower or air knife, a vacuum box, or combinations thereof. Filling assist system 1330 moves, translates, sucks, or agitates shaped abrasive particles 1302 on dispensing surface 1404 (top or upper surface of production tool 1350 in FIG. 9) to place more shaped abrasive particles 1302 into cavities 1402. Without filling assist system 1330, generally at least some of shaped abrasive particles 1302 dropped onto dispensing surface 1404 will fall directly into cavities 1402 and no further movement is required but others may need some additional movement to be directed into cavities 1402. Optionally, filling assist system 1330 can be oscillated laterally in the cross machine direction or otherwise have a relative motion such as circular or oval to the surface of production tool 1350 using a suitable drive to assist in completely filling each cavity 1402 in production tool 1350 with a shaped abrasive particle 1302. If a brush is included as a component of the filling assist system 1330, the bristles may cover a section of dispensing surface 1404 from 2-60 inches (5.0-153 cm) in length in the machine direction across all or most all of the width of dispensing surface 1404, and lightly rest on or just above dispensing surface 1404, and be of a moderate flexibility. Vacuum box 1332, if included m the filling assist system 1330, can be in conjunction with production tool 1350 having cavities 1402 extending completely through production tool 1350. Vacuum box may be located near shaped abrasive particle feeder 1320 and may be located before or after shaped abrasive particle feeder 1320, or encompass any portion of a web span between a pair of idler rolls 1310 in the shaped abrasive particle filling and excess removal section of the apparatus. Alternatively, production tool 1350 can be supported or pushed on by a shoe or a plate to assist in keeping it planar in this section of the apparatus instead or in addition to vacuum box 1332. As shown in FIG. 9, it is possible to include one or more components in system 1330 to remove excess shaped abrasive particles 1302, in some embodiments it may be possible to include only one component in system 1330.

After leaving the shaped abrasive particle filling and excess removal section of system 1300, shaped abrasive particles 1302 in production tool 1350 travel towards resin coated backing 1314. Shaped abrasive particle transfer roll 1308 is provided and production tooling 1350 can wrap at least a portion of the roll's circumference. In some embodiments, production tool 1350 wraps between 30 to 180 degrees, or between 90 to 180 degrees of the outer circumference of shaped abrasive particle transfer roll 1308. In some embodiments, the speed of the dispensing surface 1404 and the speed of the re-sin layer of resin coated backing 1314 are speed matched to each other within ±10 percent, ±5 percent, or ±1 percent, for example.

Various methods can be employed to transfer shaped abrasive particles 1302 from cavities 1402 of production tool 1350 to resin coated backing 1314. One method includes a pressure assist method where each cavity 1402 in production tooling 1350 has two open ends or the back surface or the entire production tooling 1350 is suitably porous and shaped abrasive particle transfer roll 1308 has a plurality of apertures and an internal pressurized source of air. With pressure assist, production tooling 1350 does not need to be inverted but it still may be inverted. Shaped abrasive particle transfer roll 1308 can also have movable internal dividers such that the pressurized air can be supplied to a specific arc segment or circumference of the roll to blow shaped abrasive particles 1302 out of the cavities and onto resin coated backing 1314 at a specific location. In some embodiments, shaped abrasive particle transfer roll 1308 may also be provided with an internal source of vacuum without a corresponding pressurized region or in combination with the pressurized region typically prior to the pressurized region as shaped abrasive panicle transfer roll 1308 rotates. The vacuum source or region can have movable dividers to direct it to a specific region or arc segment of shaped abrasive particle transfer roll 1308. The vacuum can suck shaped abrasive particles 1302 firmly into cavities 1402 as the production tooling 1350 wraps shaped abrasive particle transfer roll 1308 before subjecting shaped abrasive particles 1302 to the pressurized region of shaped abrasive particle transfer roll 1308. This vacuum region be used, for example, with shaped abrasive particle removal member to remove excess shaped abrasive particles 1302 from dispensing surface 1404 or may be used to simply ensure shaped abrasive particles 1302 do not leave cavities 1402 before reaching a specific position along the outer circumference of the shaped abrasive particle transfer roll 1308.

After separating from shaped abrasive particle transfer roll 1308, production tooling 1350 travels along first web path 1304 back towards the shaped abrasive particle filling and excess removal section of the apparatus with the assistance of idler rolls 1310 as necessary. An optional production tool cleaner can be provided to remove stuck shaped abrasive particles still residing in cavities 1402 anchor to remove make coat resin transferred to dispensing surface 1404. Choice of the production tool cleaner can depend on the configuration of the production tooling and could be either alone or in combination, an additional air blast, solvent or water spray, solvent or water bath, an ultrasonic horn, or an idler roll the production tooling wraps to use push assist to force shaped abrasive particles 1302 out of the cavities 1402. Thereafter production tooling 1350 or belt advances to a shaped abrasive particle filling and excess removal section to be filled with new shaped abrasive particles 1302.

Various idler rolls 1310 can be used to guide the shaped abrasive particle coated backing 1314 having a predetermined, reproducible, non-random pattern of shaped abrasive particles 1302 on the first major surface that were applied by shaped abrasive particle transfer roll 1308 and held onto the first major surface by the make coat resin along second web path 1306 into an oven for curing the make coat resin. Optionally, a second shaped abrasive particle coater can be provided to place additional abrasive particles, such as another type of abrasive particle or diluents, onto the make coat resin prior to entry in an oven. The second abrasive particle coater can be a drop coater, spray coater, or an electrostatic coater as known to those of skill in the art. Thereafter a cured backing with shaped abrasive particles 1302 can enter into an optional festoon along second web path 1306 prior to further processing such as the addition of a size coat, curing of the size coat, and other processing steps known to those of skill in the art of making coated abrasive articles.

Although system 1300 is shown as including production tool 1350 as a belt, it is possible in some alternative embodiments for system 1300 to include production tool 1350 on vacuum pull roll 1308. For example, vacuum pull roll 1308 may include a plurality of cavities 1402 to which shaped abrasive particles 1302 are directly fed. Shaped abrasive particles 1302 can be selectively held in place with a vacuum, which can be disengaged to release shaped abrasive particles 1302 on backing 1314. Further details on system 1300 and suitable alternative may be found at US 2016/0311081, to 3M Company, St. Paul MN, the contents of which are hereby incorporated by reference.

Although shaped abrasive particles are used as an example, the system. 1300 described above may also be used to accurately place non-shaped particles. Due to the configuration of the production tool 1350 placement of particles is very specifically controlled, and may be used to form patterns of a first level, second level, and higher despite the particles themselves not having any pre-determined shape. In one example, a blend of shape and non-shaped particles may also be used. In selected examples, precise placement of non-shaped particles, using methods and equipment described above may be used to form one or more symbols, that indicate product information as described below. Examples of product information include, but are not limited to, brand, particle grade, wear condition of the abrasive article, safety information, etc.

In addition to placement of shaped, or non-shaped particles, in one example, an absence of a particle from a controlled location may also be used to form one or more symbols. In selected examples, precisely controlled absence of particles, using methods and equipment described above may be used to form one or more symbols, that indicate product information as described below. One configuration to achieve a controlled absence of particles may include forming a tool, such as tool 1350 with selected cavities 1402 removed to form one or more symbols in the final product. Examples of product information include, but are not limited to, brand, particle grade, wear condition of the abrasive article, safety information, etc.

In one example any combination of more than one different approach (shaped particle, non-shaped particle, absence of particle) may be used to form one or more symbols.

Figure 11:
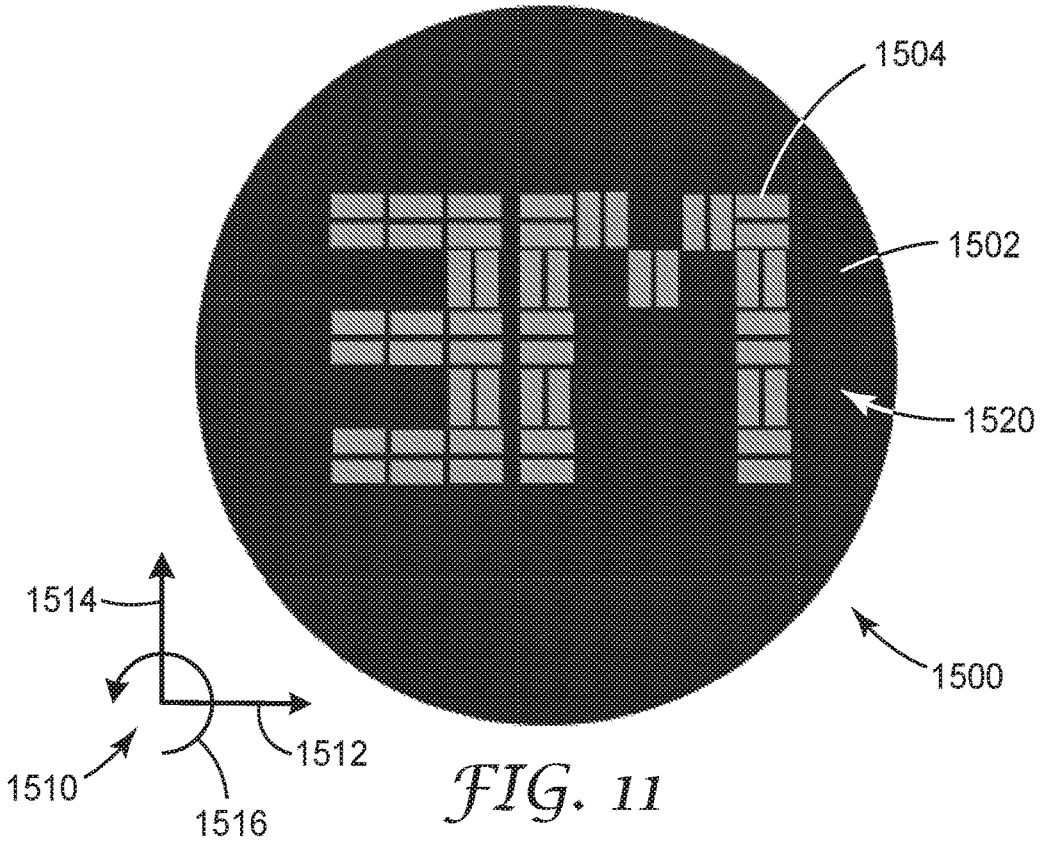
FIG. 11 is a top view of an example abrasive article in accordance with various embodiments.

FIG. 11 shows one example of an abrasive article 1500, The abrasive article 1500 illustrated from a top view, and includes a backing substrate 1502 and a plurality of shaped abrasive particles 1504. Examples of shaped abrasive particles 1504 are described above, and may include, but are not limited to triangular perimeter particles, tetrahedral particles, etc. Because of the predetermined shaped nature of the shaped abrasive particles 1504, an ordered positioning of the shaped abrasive particles 1504 on the backing substrate 1502 may be configured.

In the example of FIG. 11, the plurality of shaped abrasive particles 1504 are positioned both laterally and rotationally about a Z-axis to form one or more symbols 1520 on the backing substrate. Selected coordinate axes 1510 are shown in the figure to define the positioning of the plurality of shaped abrasive particles 1504. Lateral placement of the plurality of shaped abrasive particles 1504 is defined by translation within a plane of the backing substrate 1502. For example, a number of the plurality of shaped abrasive particles 1504 may be translated in an X-axis direction 1512 and/or a Y-axis direction 1514. In addition, a number of the plurality of shaped abrasive particles 1504 may be rotated about a Z-axis extending normal to the backing substrate 1502, as illustrated by rotation arrow 1516.

Deliberate positioning of the plurality of shaped abrasive particles 1504 may be used to form one or more symbols 1520 on the backing substrate 1504. In the example of FIG. 11, alphanumeric symbols are formed to show a "3" and an "M." Although alphanumeric symbols are shown, the invention is not so limited. Other symbols, such as geometric shapes, images, lines, arrows, etc. may also be formed with the plurality of shaped abrasive particles 1504. In one example, alphanumeric symbols may be arranged to form words, sentences, paragraphs, etc. One example arrangement of alphanumeric symbols includes a serial number. One example arrangement of alphanumeric symbols includes manufacturing information such as a date and/or factory.

In contrast to a patterned adhesive where particles are adhered in completely random fashion to the patterned adhesive, symbols formed using the methods described in the present disclosure are more precisely formed, using specific location of each individual panicle. In examples using shaped abrasive particles, the specific orientation of the particles themselves also provides the visual information for the desired symbol. This yields a more discernable and visually pleasing symbol than a symbol created with patterned adhesive and random placement of particles.

A number of possible advantages are possible using arrangements of shaped abrasive particles 1504 as described. A brand may be indicated using a formed symbol. A product type identifier may be indicated, such as disk size or band width, or drive machine compatibility. An abrasive grade identifier may be indicated, such as abrasive particle size, and/or as hardness of abrasive particles. Safety information may be included, for example, but not limited to, a maximum RPM, or other safety symbols, etc.

Figure 12:
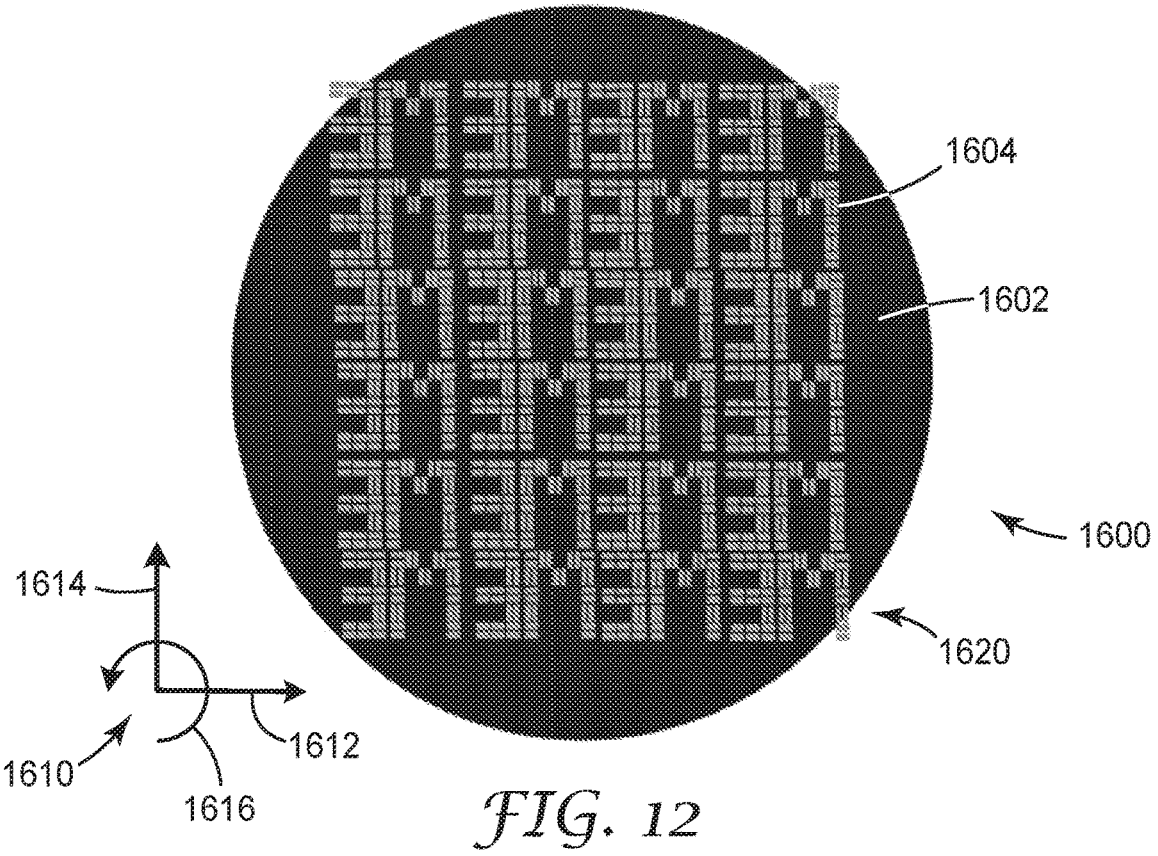
FIG. 12 is another top view of an example abrasive article in accordance with various embodiments.

FIG. 12 shows an additional example of an abrasive article 1600. Similar to FIG. 11, the abrasive article 1600 is illustrated from atop view, and includes a backing substrate 1602 and a plurality of shaped abrasive particles 1604. Similar to FIG. 11, selected coordinate axes 1610 are shown in the figure to define the positioning of the plurality of shaped abrasive particles 1604. The coordinate axes 1610 includes an X-axis direction 1612, a Y-axis direction 1614, and a Z-axis for rotation, extending normal to the backing substrate 1602, as illustrated by rotation arrow 1616.

Figure 13:
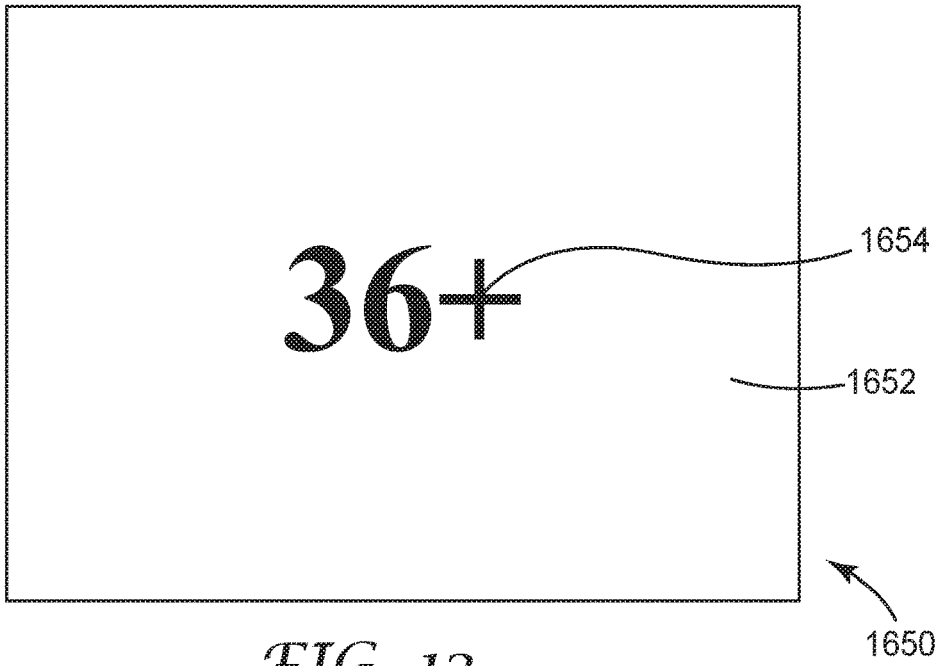
FIG. 13 is another top view of an example abrasive article in accordance with various embodiments.

FIG. 13 shows an additional example of an abrasive article 1650. Similar to FIG. 11, the abrasive article 1650 is illustrated from a top view, and includes a backing substrate 1652 and one or more symbols 1654 formed from a plurality of shaped abrasive particles. In the example of FIG. 13, the backing substrate 1652 is rectangular instead of circular. In the example of FIG. 13, the symbols indicate "36+."

As shown by FIG. 12, in one example, a plurality of symbols 1620 substantially cover a surface of the backing substrate 1602. In other examples, such as shown in FIG. 11, one or more symbols may only be a small portion of an abrasive surface.

Examples of abrasive articles that may employ one or more symbols on the backing substrate include, but are not limited to, abrasive disks, abrasive belts, and any other abrasive surface. Examples include substantially rigid abrasive substrates such as selected types of disks, and flexible abrasive substrates, such as belts.

Figure 14:
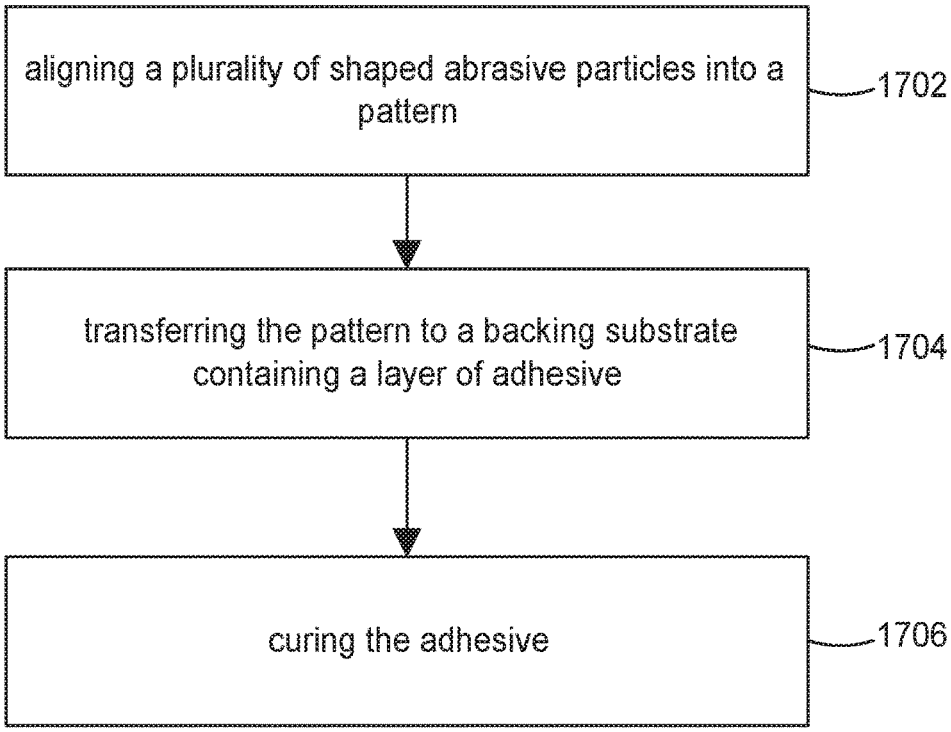
FIG. 14 is a flow diagram of an example method of manufacturing abrasive articles in accordance with various embodiments.

FIG. 14 shows an example method of forming an abrasive article that includes shaped abrasive particles. In operation 1702, a plurality of shaped abrasive particles are aligned into a pattern. In one example, the pattern includes particles positioned both laterally and rotationally about a Z-axis to form one or more symbols on the backing substrate. In operation 1704, the pattern is transferred to a backing substrate containing a layer of adhesive, and in operation 1706, the adhesive is cured.

Figure 15A:
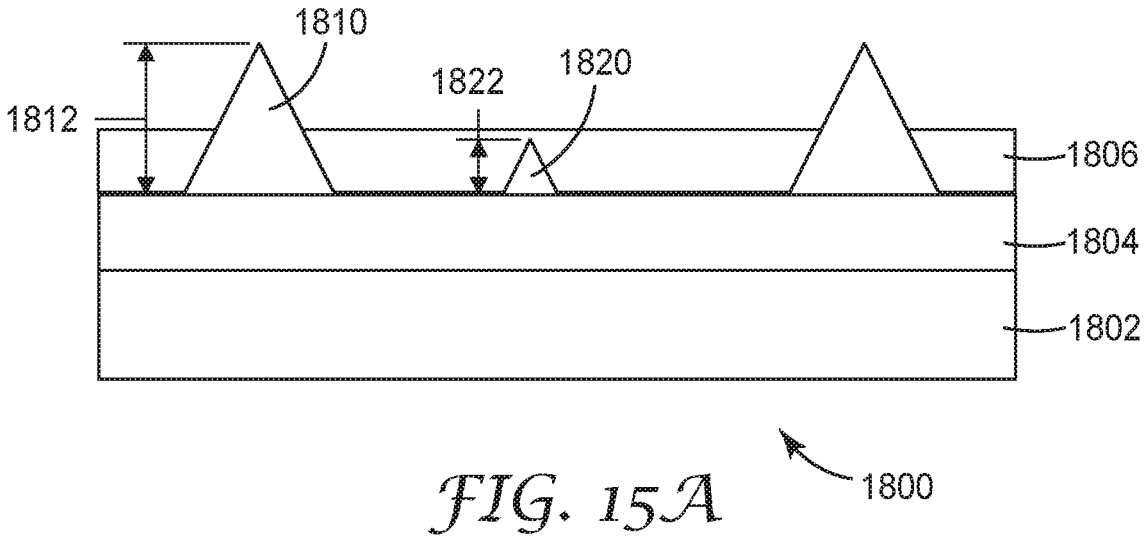
FIG. 15A is a side view of an example abrasive article in accordance with various embodiments.
Figure 15B:
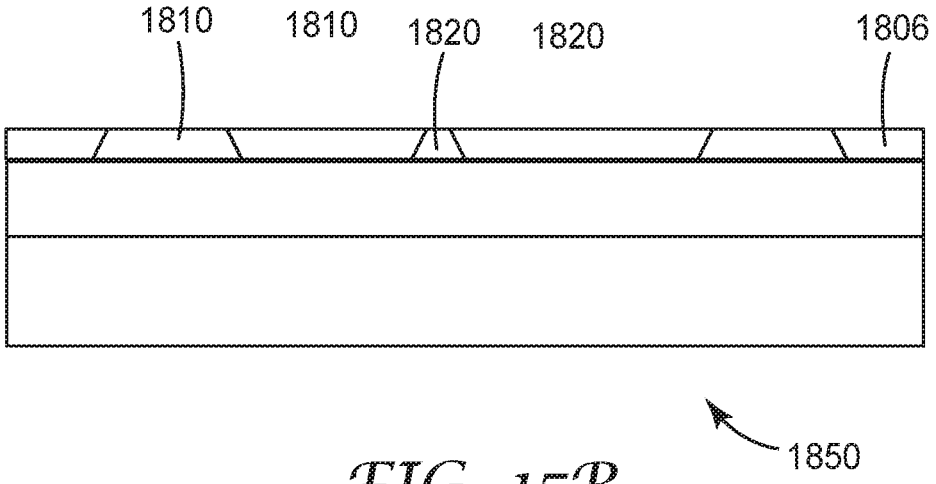
FIG. 15B is a side view of the example abrasive article from FIG. 15A after a period of wear, in accordance with various embodiments.

FIGS. 15A and 15B illustrate an additional pattern that may be formed using the method described in FIG. 14. In FIG. 15A, an abrasive article 1800 is shown. The abrasive article 1800 includes plurality of shaped abrasive particles 1810 coupled to a backing substrate 1802 using an adhesive 1804. In addition to the plurality of shaped abrasive particles 1810, a plurality of wear indicating particles 1820 are shown. The plurality of wear indicating particles 1820 have a height 1822 that is less than a height 1812 of the plurality of abrasive particles 1810. In the example shown, when the abrasive article is new, the plurality of wear indicating particles 1820 are hidden from view by a concealing layer 1806.

In use, the plurality of shaped abrasive particles 1810 will begin to wear. Over time, the plurality of shaped abrasive particles 1810 will wear to an extent that it is desirable to replace the abrasive article 1800. FIG. 15B shows the abrasive article 1800 from FIG. 15A in a worn condition 1850. In FIG. 15B, the wear indicating particles 1820 are exposed from beneath the concealing layer 1806, once the plurality of shaped abrasive particles 1810 become sufficiently worn.

In one example the wear indicating particles 1820 are identifiable by a different characteristic from the shaped abrasive particles 1810. The different characteristic may include a different color, a different pattern, a different particle shape, a different particle orientation, etc. The different characteristic is visually identifiable once the wear indicating particles 1820 are exposed from the concealing layer 1806. In one example, the wear indicating particles 1820 are arranged in to a symbol that indicates wear. In one example, the wear indicating particles 1820 include shaped wear indicating particles 1820 that may be arranged both laterally and rotationally about a Z-axis to form one or more symbols that indicate wear. The one or more symbols that indicate wear may include alphanumeric symbols. The one or more symbols that indicate wear may include words, phrases, sentences, etc. The one or more symbols that indicate wear may include shapes, lines, pictures, etc.

In one example, the wear indicating particles 1820 may be placed using similar tooling to shaped abrasive particles as described in examples above. In one example, some or all of the wear indicating particles 1820 may be placed between more precisely placed shaped abrasive particles. In one example wear indicating particles 1820 are randomly shaped, and randomly placed at an average height below a height of the shaped abrasive particles.

In one example, the wear indicating particles 1820 are abrasive particles with similar hardness and abrasive properties to the shaped abrasive particles 1810. In one example, the wear indicating particles 1820 are less abrasive than the shaped abrasive particles 1810, for example with a lower hardness and abrasive properties to the shaped abrasive particles 1810. Examples of less abrasive wear indicating particles 1820 may include relatively soft particles, such as polymer particles. Other examples of wear indicating particles 1820 may include titanium dioxide particles.

Examples of abrasive articles that may employ one or more wear indicating particles on the backing substrate include, but are not limited to, abrasive disks, abrasive belts, and any other abrasive surface. Examples include substantially rigid abrasive substrates such as selected types of disks, and flexible abrasive substrates, such as belts.

EXAMPLES

Various embodiments of the present disclosure can be better understood by reference to the following Examples which are offered by way of illustration. The present disclosure is not limited to the Examples given herein.

Example 1 includes an abrasive article, including a backing substrate, a plurality of shaped abrasive particles positioned to form one or more symbols on the backing substrate, and an adhesive coupling the plurality of shaped abrasive particles to the backing substrate.

Example 1B includes the abrasive article of example 1, wherein the plurality of shaped abrasive particles are positioned both laterally and rotationally about a Z-axis to form the one or more symbols on the backing substrate.

Example 2 includes the abrasive article of any one of examples 1-1B, wherein the one or more symbols includes one or more alphanumeric characters.

Example 3 includes the abrasive article of any one of examples 1-2, wherein the one or more symbols includes one or more words.

Example 4 includes the abrasive article of any one of examples 1-3, wherein the one or more symbols includes a product type identifier.

Example 5 includes the abrasive article of any one of examples 1-4, wherein the one or more symbols includes an abrasive grade identifier.

Example 6 includes the abrasive article of any one of examples 1-5, wherein the one or more symbols includes a brand identifier.

Example 7 includes the abrasive article of any one of examples 1-6, wherein the backing substrate is a belt.

Example 8 includes the abrasive article of any one of examples 1-7, wherein the backing substrate is a disc.

Example 9 includes the abrasive article of any one of examples 1-8, wherein at least one of the shaped abrasive particles of the plurality of shaped abrasive particles comprises a first side and a second side separated by a thickness t, the first side comprises a first face having a triangular perimeter and the second side comprises a second face having a triangular perimeter, wherein the thickness t is equal to or smaller than the length of the shortest side-related dimension of the particle.

Example 10 includes the abrasive article of any one of examples 1-9, wherein at least one of the shaped abrasive particles of the plurality of shaped abrasive particles is tetrahedral and comprises four faces joined by six edges terminating at four tips, each one of the four faces contacting three of the four faces.

Example 11 includes an abrasive article including a backing substrate and a plurality of particles on the backing substrate. The plurality of particles includes a plurality of shaped abrasive particles and a plurality of wear indicating particles having a height that is less than a height of the plurality of abrasive particles, wherein when exposed, the plurality of wear indicating particles are configured to communicate an end of product life to a user. The abrasive article includes an adhesive coupling the plurality of shaped abrasive particles to the backing substrate.

Example 12 includes the abrasive article of example 11, wherein the plurality of wear indicating particles are shaped particles that are positioned both laterally and rotationally about a Z-axis to form one or more symbols on the backing substrate to communicate the end of product life.

Example 13 includes the abrasive article of any one of examples 11-12, wherein the plurality of wear indicating particles are colored differently from the plurality of shaped abrasive particles to communicate the end of product life.

Example 14 includes the abrasive article of any one of examples 11-13, wherein the plurality of wear indicating particles are abrasive particles.

Example 15 includes the abrasive article of any one of examples 11-14, wherein the plurality of wear indicating particles are less abrasive than the plurality of shaped abrasive particles.

Example 16 includes a method of forming an abrasive article, including aligning a plurality of shaped abrasive particles into a pattern, wherein the pattern includes particles positioned both laterally and rotationally about a Z-axis to form one or more symbols on the backing substrate, transferring the pattern to a backing substrate containing a layer of adhesive, and curing the adhesive.

Example 17 includes the method of example 16, wherein aligning a plurality of shaped abrasive particles into a pattern includes collecting the plurality of shaped abrasive particles into pockets arranged on a tooling surface.

Example 18 includes the method of any one of examples 16-17, further including holding the plurality of shaped abrasive particles in the pockets using a vacuum source, prior to transferring the pattern to the backing substrate.

The terms and expressions that have been employed are used as terms of description and not of limitation, and there is no intention in the use of such terms and expressions of excluding any equivalents of the features shown and described or portions thereof, but it is recognized that various modifications are possible within the scope of the embodiments of the present disclosure. Thus, it should be understood that although the present disclosure has been specifically disclosed by specific embodiments and optional features, modification and variation of the concepts herein disclosed may be resorted to by those of ordinary skill in the art, and that such modifications and variations are considered to be within the scope of embodiments of the present disclosure.

What is claimed is:

1. An abrasive article, comprising:

a backing substrate; a plurality of particles on the backing substrate adhered to the backing substrate by a make coat, including;

a plurality of shaped ceramic abrasive particles consisting essentially of sintered alpha alumina;

a plurality of wear indicating particles having a height that is less than a height of the plurality of shaped ceramic abrasive particles, wherein when exposed, the plurality of wear indicating particles are configured to communicate an end of product life to a user, wherein the plurality of wear indicating particles are colored differently from the plurality of shaped ceramic abrasive particles and are positioned on the backing to form one or more symbols; and a concealing layer, wherein when the abrasive article is new, the plurality of wear indicating particles are hidden from view by the concealing layer and portions of the plurality of shaped ceramic abrasive particles are visible above the concealing layer.

2. The abrasive article of claim 1, wherein the one or more symbols includes one or more alphanumeric characters.

3. The abrasive article of claim 1, wherein the one or more symbols includes one or more words.

4. The abrasive article of claim 1, wherein the one or more symbols includes a product type identifier.

5. The abrasive article of claim 1, wherein the one or more symbols includes an abrasive grade identifier.

6. The abrasive article of claim 1, wherein the one or more symbols includes a brand identifier.

7. The abrasive article of claim 1, wherein the backing substrate is a belt.

8. The abrasive article of claim 1, wherein the backing substrate is a disc.

9. The abrasive article of claim 1, wherein at least one of the shaped ceramic abrasive particles of the plurality of shaped ceramic abrasive particles comprises a first side and a second side separated by a thickness t, the first side comprises a first face having a triangular perimeter and the second side comprises a second face having a triangular perimeter, wherein the thickness t is equal to or smaller than the length of the shortest side-related dimension of the particle.

10. The abrasive article of claim 1, wherein at least one of the shaped ceramic abrasive particles of the plurality of shaped ceramic abrasive particles is tetrahedral and comprises four faces joined by six edges terminating at four tips, each one of the four faces contacting three of the four faces.

11. The abrasive article of claim 1, wherein the plurality of wear indicating particles are shaped particles that are positioned both laterally and rotationally about a Z-axis.

12. The abrasive article of claim 1, wherein the plurality of wear indicating particles are abrasive particles.

13. The abrasive article of claim 1, wherein the plurality of wear indicating particles are less abrasive than the plurality of shaped ceramic abrasive particles.

* * * * *